US008438033B2

(12) United States Patent
Tamura et al.

(10) Patent No.: US 8,438,033 B2
(45) Date of Patent: May 7, 2013

(54) VOICE CONVERSION APPARATUS AND METHOD AND SPEECH SYNTHESIS APPARATUS AND METHOD

(75) Inventors: Masatsune Tamura, Kawasaki (JP); Masahiro Morita, Yokohama (JP); Takehiko Kagoshima, Yokohama (JP)

(73) Assignee: Kabushiki Kaisha Toshiba, Minato-ku (JP)

( * ) Notice: Subject to any disclaimer, the term of this patent is extended or adjusted under 35 U.S.C. 154(b) by 960 days.

(21) Appl. No.: 12/505,684

(22) Filed: Jul. 20, 2009

(65) Prior Publication Data

US 2010/0049522 A1 Feb. 25, 2010

(30) Foreign Application Priority Data

Aug. 25, 2008 (JP) ..... 2008-215711

(51) Int. Cl.
*G10L 13/06* (2006.01)
*G10L 13/00* (2006.01)
*G10L 21/00* (2006.01)

(52) U.S. Cl.
USPC ..... 704/268; 704/262; 704/264; 704/270; 381/54

(58) Field of Classification Search ..... None
See application file for complete search history.

(56) References Cited

U.S. PATENT DOCUMENTS

| | | | | |
|---|---|---|---|---|
| 5,327,521 | A * | 7/1994 | Savic et al. | 704/272 |
| 6,336,092 | B1 * | 1/2002 | Gibson et al. | 704/268 |
| 6,615,174 | B1 * | 9/2003 | Arslan et al. | 704/270 |
| 7,765,101 | B2 * | 7/2010 | En-Najjary et al. | 704/246 |
| 7,792,672 | B2 * | 9/2010 | Rosec et al. | 704/246 |
| 8,255,222 | B2 * | 8/2012 | Hirose et al. | 704/261 |
| 2003/0055647 | A1 * | 3/2003 | Yoshioka et al. | 704/258 |
| 2005/0137870 | A1 | 6/2005 | Mizutani et al. | 704/264 |
| 2006/0235685 | A1 * | 10/2006 | Nurminen et al. | 704/235 |
| 2007/0168189 | A1 * | 7/2007 | Tamura et al. | 704/235 |
| 2008/0201150 | A1 | 8/2008 | Tamura et al. | 704/266 |
| 2008/0312931 | A1 | 12/2008 | Mizutani et al. | 704/260 |
| 2009/0144053 | A1 | 6/2009 | Tamura et al. | 704/207 |
| 2009/0177474 | A1 | 7/2009 | Morita et al. | 704/260 |

FOREIGN PATENT DOCUMENTS

| | | |
|---|---|---|
| JP | 3631657 | 12/2004 |
| JP | 2007-193139 | 8/2007 |

OTHER PUBLICATIONS

Stylianou; et al.; "*Continuous Probabilistic Transform for Voice Conversion*"; IEEE Transactoins on Speech and Audio Processing, 1998, vol. 6, No. 2pp. 131-142.

* cited by examiner

*Primary Examiner* — Brian Albertalli
(74) *Attorney, Agent, or Firm* — Ohlandt, Greeley, Ruggiero & Perle, L.L.P.

(57) ABSTRACT

A voice conversion apparatus stores, in a parameter memory, target speech spectral parameters of target speech, stores, in a voice conversion rule memory, a voice conversion rule for converting voice quality of source speech into voice quality of the target speech, extracts, from an input source speech, a source speech spectral parameter of the input source speech, converts extracted source speech spectral parameter into a first conversion spectral parameter by using the voice conversion rule, selects target speech spectral parameter similar to the first conversion spectral parameter from the parameter memory, generates an aperiodic component spectral parameter representing from selected target speech spectral parameter, mixes a periodic component spectral parameter included in the first conversion spectral parameter with the aperiodic component spectral parameter, to obtain a second conversion spectral parameter, and generates a speech waveform from the second conversion spectral parameter.

17 Claims, 19 Drawing Sheets

| Speech segment number | Phoneme (phoneme name) | Fundamental frequency (Hz) | Phoneme duration time (msec) | Connection boundary spectral parameter |
|---|---|---|---|---|
| 1 | /a-LEFT/ | 308.6 | 56.1 | $c_1(1)$、$c_1(T)$ |
| 2 | /a-LEFT/ | 300.5 | 36.5 | $c_2(1)$、$c_2(T)$ |
| 3 | /a-LEFT/ | 334.6 | 54.2 | $c_3(1)$、$c_3(T)$ |
| : | : | : | : | : |

VOICE CONVERSION APPARATUS AND METHOD AND SPEECH SYNTHESIS APPARATUS AND METHOD

CROSS-REFERENCE TO RELATED APPLICATIONS

This application is based upon and claims the benefit of priority from prior Japanese Patent Application No. 2008-215711, filed Aug. 25, 2008, the entire contents of which are incorporated herein by reference.

BACKGROUND OF THE INVENTION

1. Field of the Invention

The present invention relates to a voice conversion apparatus and method which convert the voice quality of source speech into that of target speech.

2. Description of the Related Art

A technique of inputting source speech and converting its voice quality into that of target speech is called a voice conversion technique. According to the voice conversion technique, first of all, spectral information of speech is represented by a spectral parameter, and a voice conversion rule is learned from the relationship between a source spectral parameter and a target spectral parameter. Then, a spectral parameter that is obtained by analyzing arbitrary source input speech is converted into a target spectral parameter by using the voice conversion rule. The voice quality of the input speech is converted into target voice quality by synthesizing a speech waveform from the obtained spectral parameter.

As a method for voice conversion, a voice conversion method of performing voice conversion based on a mixture Gaussian distribution (GMM) is disclosed (see, for example, reference 1 [Y. Stylianou et al., "Continuous Probabilistic Transform for Voice Conversion", IEEE Transactions of Speech and Audio Processing, Vol. 6, No. 2, March 1988]). According to reference 1, a GMM is obtained from source speech spectral parameters, and a regression matrix in each mixture of a GMM is obtained by performing regression analysis on a pair of a source spectral parameter and a target spectral parameter. This regression matrix is used as a voice conversion rule. In applying voice conversion, a target spectral parameter is obtained by using a regression matrix after weighting by the probability that an input source speech spectral parameter is output in each mixture of a GMM.

In GMM regression analysis, learning is performed so as to minimize an error by using a cepstrum as a spectral parameter. It is, however, difficult to properly perform voice conversion of a component representing an aperiodic characteristic of a spectrum, e.g., the high-frequency component of the spectrum. As a result, the voice-converted speech exhibits a muffled sense and a sense of noise.

There is disclosed a voice conversion apparatus which performs conversion/grouping of frequency warping functions and spectrum slopes generated for each phoneme and performs voice conversion by using an average frequency warping function and spectrum slope of each group, thereby converting the voice quality spectrum of the first speaker into the voice quality spectrum of the second speaker (see reference 2: Japanese Patent No. 3631657). A frequency warping function is obtained by nonlinear frequency matching, and a spectrum slope is obtained by a least-squares approximated slope. Conversion is performed based on a slope difference.

Although a frequency warping function is properly obtained for a clearly periodic component having a formant structure, it is difficult to obtain such a function for a component representing an aperiodic characteristic of a spectrum such as the high-frequency component of the spectrum. Conversion by slope correction is thought to be difficult to increase the similarity with a target speaker because of strong constraints from the conversion rules. As a result, the voice-converted speech exhibits a muffled sense or a sense of noise, and the similarity with the target voice quality decreases.

A technique of inputting an arbitrary sentence and generating a speech waveform is called "text speech synthesis". Text speech synthesis is generally performed in three steps in a language processing unit, a prosodic processing unit, and a speech synthesis unit. First of all, the language processing unit performs text analysis such as morphemic analysis, syntactic analysis, for an input text. The prosodic processing unit performs accent processing and intonation processing to output phoneme sequence/prosodic information (fundamental frequency, phoneme duration time, and the like). Finally, the speech waveform generation unit generates a speech waveform from the phoneme sequence/prosodic information.

As one of speech synthesis methods, there is a segment-selection speech synthesis method which selects and synthesizes speech segment sequences from a speech segment database containing a large quantity of speech segments, considering input phoneme sequence/prosodic information as objective information. In segment-selection speech synthesis, speech segments are selected from a large quantity of speech segments stored in advance based on input phoneme sequence/prosodic information, and the selected speech segments are connected to synthesize speech. In addition, there is available a plural-segment-selection speech synthesis method which selects a plurality of speech segments for each synthesis unit of an input phoneme sequence based on the degree of distortion of synthetic speech, considering input phoneme sequence/prosodic information as objective information, generates new speech segments by fusing the plurality of selected speech segments, and synthesizes speech by conatenating them. As a fusing method, for example, a method of averaging pitch waveforms is used.

There is disclosed a method of performing voice conversion of a speech segment database for text speech synthesis such as the above segment-selection speech synthesis or plural-segment-selection speech synthesis by using a small amount of target speech data as objective data (see reference 3: JP-A 2007-193139(KOKAI)). According to reference 3, voice conversion rules are learned by using a large amount of source speech data and a small amount of target speech data, and the obtained voice conversion rules are applied to a source speech segment database for speech synthesis, thereby implementing speech synthesis of an arbitrary sentence with target voice quality. In reference 3, voice conversion rules are based on the method disclosed in reference 1, and it is difficult to properly perform voice conversion of aperiodic component such as the high-frequency component of a spectrum as in reference 1. As a result, the voice-converted speech exhibits a muffled sense or a sense of noise.

As described above, according to references 1 and 3 as conventional techniques, voice conversion is performed based on a technique such as regression analysis for spectral data. According to reference 2, voice conversion is performed by using frequency warping and slope correction. However, it is difficult to properly convert the aperiodic component of a spectrum. As a result, the speech obtained by voice conversion sometimes exhibits a muffled sense or a sense of noise, resulting in a reduction in similarity with target voice quality.

Assume that all spectral components are generated by using target speech. In this case, if only a small amount of target speech is stored in advance, it is impossible to generate proper target speech.

BRIEF SUMMARY OF THE INVENTION

According to embodiments of the present invention, a voice conversion apparatus includes:

a parameter memory to store a plurality of target speech spectral parameters representing characteristics of voice quality of target speech;

a voice conversion rule memory to store a voice conversion rule for converting voice quality of source speech into voice quality of the target speech;

an extraction unit configured to extract, from an input source speech, a source speech spectral parameter representing a characteristic of voice quality of the input source speech;

a parameter conversion unit configured to convert extracted source speech spectral parameter into a first conversion spectral parameter by using the voice conversion rule;

a parameter selection unit configured to select at least one target speech spectral parameter similar to the first conversion spectral parameter from the target speech spectral parameters stored in the parameter memory;

an aperiodic component generation unit configured to generate an aperiodic component spectral parameter representing an aperiodic component of voice quality from selected target speech spectral parameter;

a parameter mixing unit configured to mix a periodic component spectral parameter representing a periodic component of voice quality included in the first conversion spectral parameter with the aperiodic component spectral parameter, to obtain a second conversion spectral parameter; and a speech waveform generation unit configured to generate a speech waveform from the second conversion spectral parameter.

DETAILED DESCRIPTION OF THE INVENTION

First Embodiment

Figure 1:
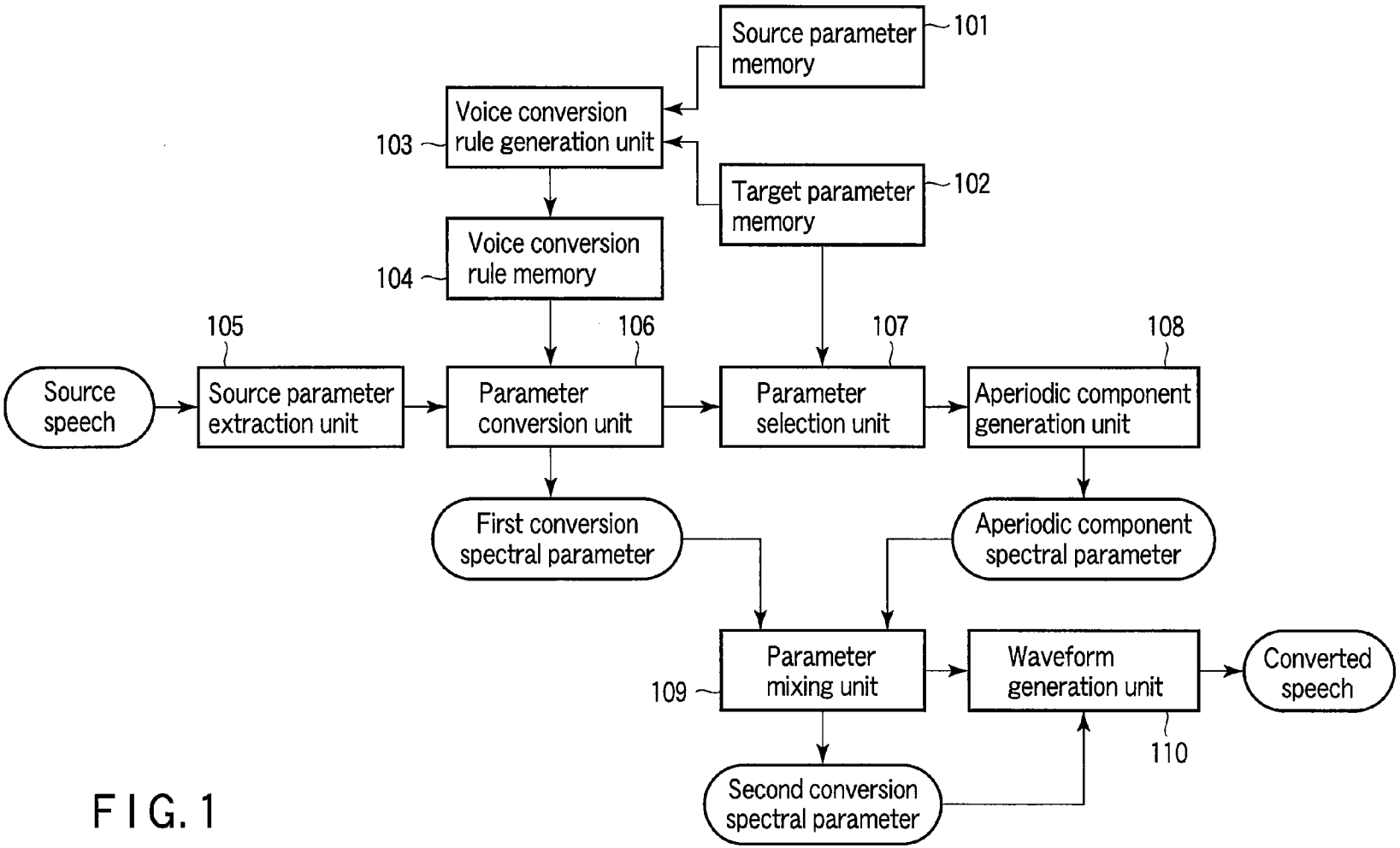
FIG. 1 is a block diagram showing an example of the arrangement of a voice conversion apparatus according to the first embodiment.

In a voice conversion apparatus in FIG. 1, a source parameter memory 101 stores a plurality of source speech spectral parameters, and a target parameter memory 102 stores a plurality of target speech spectral parameters.

A voice conversion rule generation unit 103 generates voice conversion rules by using the source spectral parameters stored in the source parameter memory 101 and the target spectral parameters stored in the target parameter memory 102. This voice conversion rules are stored in a voice conversion rule memory 104.

A source parameter extraction unit 105 extracts a source spectral parameter from source speech. A parameter conversion unit 106 obtains the first conversion spectral parameter by performing voice conversion of the extracted source spectral parameter by using a voice conversion rule stored in the voice conversion rule memory 104.

When a parameter selection unit 107 selects a source spectral parameter from the target parameter memory 102, an aperiodic component generation unit 108 generates an aperiodic component spectral parameter from the selected target spectral parameter.

A parameter mixing unit 109 obtains the second conversion spectral parameter by mixing the periodic component of the first conversion spectral parameter with the above aperiodic component spectral parameter.

A waveform generation unit 110 obtains converted speech by generating a speech waveform from the second conversion spectral parameter.

The voice conversion apparatus in FIG. 1 generates target speech by performing voice conversion of input source speech with the above arrangement.

The source parameter memory 101 and the target parameter memory 102 respectively store the source spectral parameters extracted from source voice quality speech data and the target spectral parameters extracted from target voice quality speech data. The voice conversion rule generation unit 103 generates voice conversion rules by using these spectral parameters.

A spectral parameter is a parameter representing the spectral information of speech, and is a feature parameter used for voice conversion, e.g., the discrete spectrum generated by Fourier transform, an LSP coefficient, a cepstrum, a mel-cepstrum, or a local-band base (to be described later). Considering that a segment database for speech synthesis is to be efficiently generated, assume that the source parameter memory 101 stores a medium to large amount of source spectral parameters, and the target parameter memory 102 stores a small amount of target spectral parameters.

According to the voice conversion apparatus in FIG. 1, only preparing a small amount of speech with target voice quality as an objective voice quality, synthetic speech of an arbitrary sentence with the voice quality can be generated.

The voice conversion rule generation unit 103 generates voice conversion rules from the source spectral parameters stored in the source parameter memory 101 and the target spectral parameters stored in the target parameter memory 102. A voice conversion rule is a rule for converting a source voice quality spectral parameter into a target voice quality spectral parameter from the relationship between a source spectral parameter and a target spectral parameter.

Voice conversion rules can be obtained by a technique such as regression analysis, regression analysis based on a GMM (non-patent reference 1), or frequency warping (patent reference 1). Parameters for voice conversion rules are generated from pairs of learning data obtained by associating source spectral parameters with target spectral parameters (patent reference 2).

The voice conversion rule memory 104 stores the voice conversion rules generated by the voice conversion rule generation unit 103, and also stores information for selecting a voice conversion rule if there are a plurality of voice conversion rules.

The source parameter extraction unit 105 obtains a source spectral parameter from input source speech. The source parameter extraction unit 105 obtains a source spectral parameter by extracting a speech frame having a predetermined length from the source speech and analyzing the spectrum of the obtained speech frame. The parameter conversion unit 106 obtains the first conversion spectral parameter by performing voice conversion of the source spectral parameter using a voice conversion rule stored in the voice conversion rule memory 104.

The parameter selection unit 107 selects a target spectral parameter corresponding to the first conversion spectral parameter from the target parameter memory 102. A target spectral parameter is selected based on the similarity with the first conversion spectral parameter. A similarity is given as a numerical value representing the degree of similarity between each target spectral parameter stored in the target parameter memory 102 and the first conversion spectral parameter. A similarity can be obtained based on a spectral distance or a cost function given as a numerical value representing a difference in attribute such as the prosodic information of a source spectral parameter or phonetic environment. The parameter selection unit 107 may select a plurality of target spectral parameters as well as only one target spectral parameter for the first conversion spectral parameter.

The aperiodic component generation unit 108 generates an aperiodic component spectral parameter from the selected target spectral parameter.

A speech spectrum is roughly segmented into a periodic component and an aperiodic component. In general, the speech waveform of a voiced sound is represented by a periodic waveform having a pitch period. A component synchronized with this pitch period is called a periodic component, and the remaining component is called an aperiodic component. A periodic component is a component which is mainly excited by the vibration of the vocal cord and has a spectrum envelope conforming to vocal tract characteristics and radiation characteristics. An aperiodic component is mainly generated by elements other than the vibration of the vocal cord, e.g., a noise-like component generated by air sound turbulence generated in the vocal tract or an impulse-sound component generated when an air flow is temporarily held and then is the released. In a voiced sound, a low-frequency component having strong power contains many periodic components, whereas aperiodic components are mainly contained in the high-frequency band of the spectrum. Therefore, a high-frequency component and a low-frequency component in two bands divided by a given boundary frequency are sometimes processed as an aperiodic component and a periodic component, respectively. Alternatively, speech is sometimes analyzed by a window function corresponding to an integer multiple of a pitch to generate an aperiodic component on the basis of the amplitude of a frequency other than an integer multiple of the fundamental frequency and to generate a periodic component based on a harmonic component corresponding to an integer multiple of the fundamental frequency.

The aperiodic component generation unit 108 separates the selected target spectral parameter into a periodic component and an aperiodic component, and extracts an aperiodic component spectral parameter. If a plurality of target spectral parameters are selected, an aperiodic component spectral parameter representing the aperiodic components of the plurality of target spectral parameters is generated. For example, it is possible to generate an aperiodic component spectral parameter by extracting an aperiodic component after averaging a plurality of selected spectral parameters.

The parameter mixing unit 109 generates the second conversion spectral parameter from the first conversion spectral parameter obtained by the parameter conversion unit 106 and the aperiodic component spectral parameter generated by the aperiodic component generation unit 108.

First of all, the parameter mixing unit 109 separates the first conversion spectral parameter into a periodic component and an aperiodic component, and extracts the periodic component of the first conversion spectral parameter. This separation processing is the same as that performed by the aperiodic component generation unit 108. That is, when a spectral parameter is to be separated into a low-frequency component and a high-frequency component by setting a boundary frequency, it is possible to separate the parameter by using the boundary frequency obtained by the aperiodic component generation unit 108 and to extract the low-frequency component as a periodic component. It is also possible to extract a periodic component from the first conversion spectral parameter by extracting a harmonic component corresponding to an integer multiple of the fundamental frequency. The parameter mixing unit 109 generates the second conversion spectral parameter by mixing the periodic component of the first conversion spectral parameter, extracted in this manner, with the aperiodic component spectral parameter generated by the aperiodic component generation unit 108.

As described above, in this embodiment, a periodic component is generated by performing voice conversion of a source spectral parameter, and an aperiodic component is generated from a target spectral parameter. A periodic component tends to be auditorily sensitive to variations in phonetic environment and the like. In contrast to this, an aperiodic component tends to exhibit relatively low sensitivity to variations in acoustic environment, even though it has a great influence on the personality of a speaker. In addition, in conversion of an aperiodic component, since the component is low in power and is a noise-like component, it is difficult to statistically generate a conversion rule. For this reason, the reproducibility of a target speech feature is higher when it is directly generated from a target spectral parameter than when it is generated by conversion. Therefore, even when only a small amount of target spectral parameters are stored in the target parameter memory 102, a proper second conversion spectral parameter (closer to target speech) can be obtained as compared with a case in which such a parameter is generated by voice conversion of the entire band.

The waveform generation unit 110 generates a speech waveform from the second conversion spectral parameter. The waveform generation unit 110 generates speech waveforms by driving a filter upon supplying an excitation source to it, performing inverse Fourier transform by giving a proper phase to a discrete spectrum obtained from the second conversion spectral parameter, and superimposing the resultant waveforms in accordance with pitch marks. Converted speech is obtained by concatenating the speech waveforms.

The processing operation of the voice conversion apparatus according to the first embodiment will be described next with reference to the flowchart shown in FIG. 2. First of all, the source parameter extraction unit 105 extracts the waveform of each speech frame from input source speech (step S201), and obtains a source spectral parameter by analyzing the spectrum of the extracted speech frame (step S202).

The parameter conversion unit 106 selects a voice conversion rule from the voice conversion rule memory 104 (step S203), and obtains the first conversion spectral parameter by converting the source spectral parameter by using the selected voice conversion rule (step S204).

The parameter selection unit 107 calculates the similarity between the obtained first conversion spectral parameter and each target spectral parameter stored in the target parameter memory 102 (step S205), and selects one or a plurality of target spectral parameters exhibiting the highest similarity with the first conversion spectral parameter (step S206).

The aperiodic component generation unit 108 calculates and obtains information used to separate periodic and aperiodic components, e.g., a boundary frequency, from the selected target spectral parameter (step S207). The aperiodic component generation unit 108 then actually separates the target spectral parameter into a periodic component and an aperiodic component by using the obtained information (e.g., a boundary frequency), and extracts an aperiodic component spectral parameter (step S208).

First of all, the parameter mixing unit 109 separates the first conversion spectral parameter obtained in step S204 into periodic and aperiodic components and extracts the periodic component of the first conversion spectral parameter (step S209). The parameter mixing unit 109 then generates the second conversion spectral parameter by mixing the extracted periodic component of the first conversion spectral parameter with the aperiodic component spectral parameter obtained in step S208 (step S210).

Finally, the waveform generation unit 110 generates a speech waveform from each second conversion spectral parameter obtained in this manner (step S211), and generates voice-converted speech by concatenating the generated speech waveforms (step S212).

The processing operation of the voice conversion apparatus according to the first embodiment will be described in more detail below based on a concrete example. The voice conversion apparatus according to this embodiment can use various methods in the respective steps, e.g., a voice conversion method, a periodic/aperiodic separation method, a target spectrum selection method, and a waveform generation method. The following will exemplify a case in which the voice conversion apparatus uses spectrum envelope parameters based on local-band bases as spectral parameters and frequency warping and multiplication parameters as voice conversion rules, and performs periodic/aperiodic separation based on the cumulative value of power obtained from spectral parameters.

Spectrum envelope parameters based on local-band bases will be described. The source parameter memory 101 and the target parameter memory 102 respectively store spectrum envelop parameters obtained from speech data. The source parameter extraction unit 105 extracts a spectrum envelop parameter from input source speech. The spectrum envelop parameter based on local-band bases expresses the spectral information obtained from the speech by a linear combination of local-band bases. In this case, a logarithmic spectrum is used as spectral information, and local-band bases to be used are generated by using a Hanning window for a predetermined frequency scale.

Figure 3:
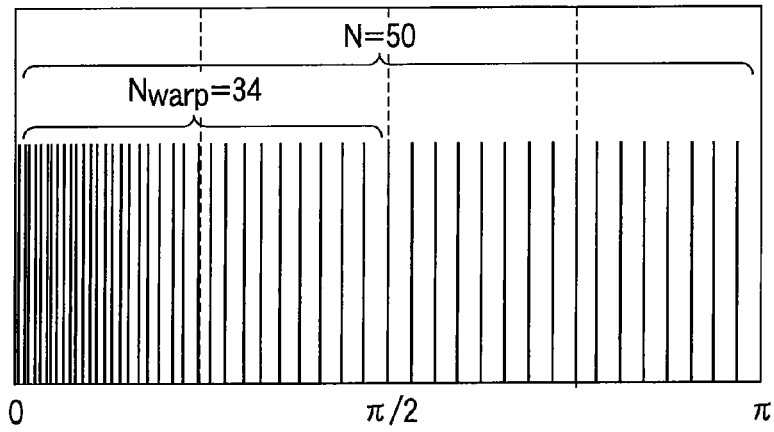
FIG. 3 is a view showing an example of a frequency scale for explaining a spectral parameter.

FIG. 3 shows a frequency scale. Referring to FIG. 3, the abscissa represents the frequency, and the frequency scale indicates frequency intervals in this manner. According to the frequency scale set in FIG. 3, equidistant points on the Mel scale from 0 to $\pi/2$ are given by $$\Omega(i) = \omega + 2\tan^{-1}\frac{\alpha\sin\omega}{1-\alpha\cos\omega},\quad \omega = \frac{i}{N_{warp}}\pi,\quad i < N_{warp} \tag{1}$$

and equidistant points on the linear scale from $\pi/2$ to $\pi$ are given by $$\Omega(i) = \frac{i - N_{warp}}{N - N_{warp}}\pi + \frac{\pi}{2},\quad N_{warp} \le i < N \tag{2}$$

$N_{warp}$ is obtained such that band intervals smoothly change from the Mel-scale band to the equidistant bands. When a 22.05-khz signal is to be obtained with N=50 and $\alpha$=0.35, $N_{warp}$=34. Reference symbol $\Omega(i)$ denotes the ith peak frequency. A scale is set in this manner, and local-band bases are generated in accordance with the intervals. A base vector $\phi_i(k)$ is generated by using a Hanning window. With regard to $1 \leqq i \leqq N-1$, a base vector is generated according to $$\phi_i(k) = \begin{cases} 0.5 - 0.5\cos\left(\frac{k - \Omega(i-1)}{\Omega(i) - \Omega(i-1)}\pi\right) & \ldots \ \Omega(i-1) \le k < \Omega(i) \\ 0.5 - 0.5\cos\left(\frac{k - \Omega(i)}{\Omega(i+1) - \Omega(i)}\pi\right) & \ldots \ \Omega(i) \le k < \Omega(i+1) \\ 0 & \ldots \ \text{otherwise} \end{cases} \quad (3)$$

With regard to i=0, a base vector is generated according to $$\phi_i(k) = \begin{cases} 0.5 - 0.5\cos\left(\frac{k - \Omega(i)}{\Omega(i+1) - \Omega(i)}\pi\right) & \ldots \ \Omega(i) \le k < \Omega(i+1) \\ 0 & \ldots \ \text{otherwise} \end{cases} \quad (4)$$

For, $\Omega(0)=0$ and $\Omega(N)=\pi$

That is, a plurality of bases corresponding to N peak frequencies have values falling in arbitrary frequency bands including the peak frequencies, and the values outside the frequency bands are zero. In addition, two adjacent bases (adjacent peak frequencies) have their values existing in frequency bands which overlap each other.

Figure 4A:
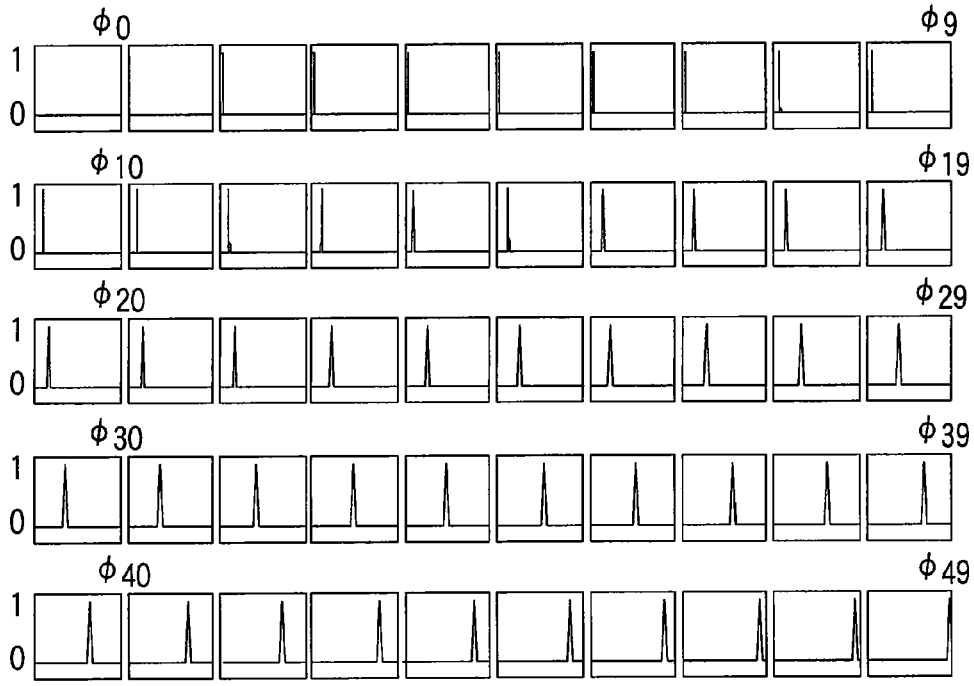
FIG. 4A is a view showing an example of local-band bases for explaining a spectral parameter.
Figure 4B:
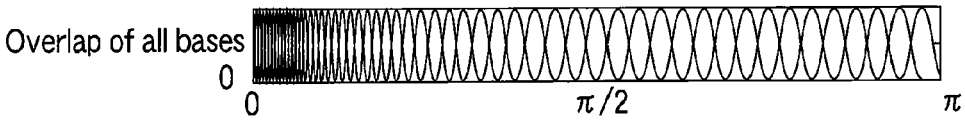
FIG. 4B is a view showing a state in which all the local-band bases are overlapped.

FIGS. 4A and 4B show local-band bases generated in this manner. FIG. 4A is a plot of the respective bases. FIG. 4B shows an overlap of all the local-band bases. A logarithmic spectrum is expressed by using the bases and coefficients corresponding to the respective bases. A logarithmic spectrum X(k) obtained by Fourier transform of speech data x(n) is represented as a linear combination of N points as follows:

$$X(k) = \sum_{i=0}^{N-1} c_i \phi_i(k), \ (0 \le k < L) \quad (5)$$

A coefficient $c_i$ can be obtained by the least squares method. Coefficients obtained in this manner are used as spectral parameters.

That is, Lth-order spectrum envelope information, which is a spectrum, from which the fine-structure component of the spectrum based on the periodicity of a sound source is removed, is obtained from a speech signal. The base coefficients $c_i$ are obtained so as to minimize the distortion amount between a linear combination of N (L>N>1) bases and the corresponding base coefficients $c_i$ and the extracted spectrum envelope information. A set of these base coefficients is the spectral parameter of spectrum envelope information.

Figure 5A:
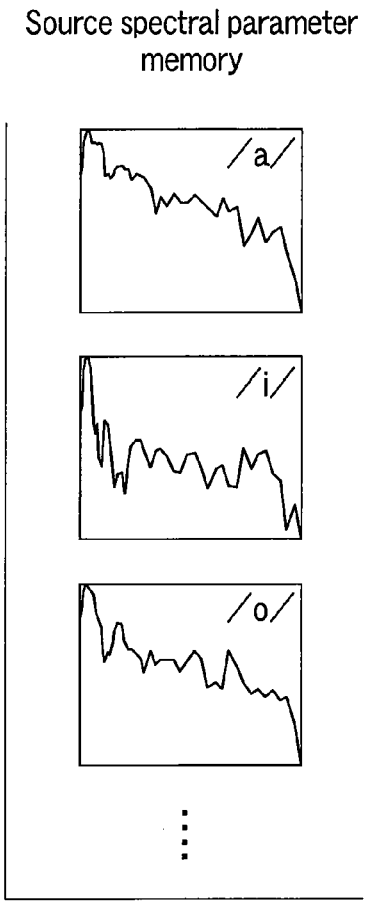
FIG. 5A is a view showing an example of how spectral parameters are stored in a source spectral parameter memory.
Figure 5B:
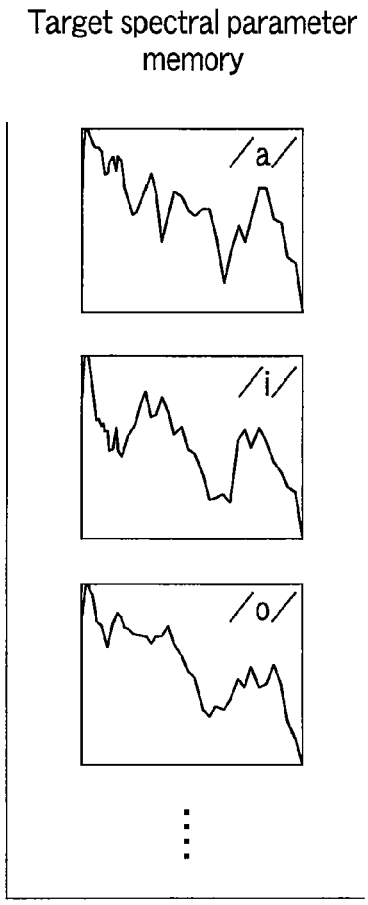
FIG. 5B is a view showing an example of how spectral parameters are stored in a target spectral parameter memory.

FIG. 5A shows an example of spectral parameters obtained from source speech data and stored in the source parameter memory 101. FIG. 5B shows an example of spectral parameters obtained from target speech data and stored in the target parameter memory 102.

FIGS. 5A and 5B show examples of spectral parameters respectively obtained from source speech and target speech prepared as speech data for the generation of voice conversion rules.

Figure 6:
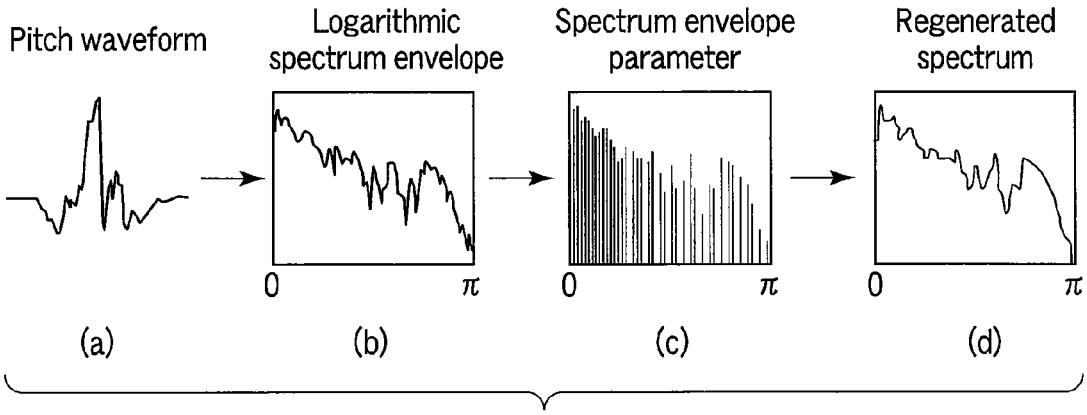
FIG. 6 shows an example of how a spectrum envelope parameter is extracted.

FIG. 6 shows an example of how a spectrum envelop parameter is extracted. A logarithmic spectrum envelope ((b) in FIG. 6) is obtained from the pitch waveform ((a) in FIG. 6) obtained from speech data. The coefficient $c_i$ ((c) in FIG. 6) is obtained according to Equation 5 ((c) in FIG. 6). In FIG. 6, (d) shows the spectrum envelope reconstructed from the coefficient and the base. As shown in (c) in FIG. 6, a spectrum envelop parameter based on local-band bases is a parameter representing a rough approximation of a spectrum, and hence has a characteristic that frequency warping, which is the extension/reduction of a spectrum in the frequency direction, can be implemented by mapping a parameter in each dimension.

The voice conversion rule memory 104 stores the voice conversion rules generated from the source spectral parameters stored in the source parameter memory 101 and the target spectral parameters stored in the target parameter memory 102. When frequency warping functions and multiplication parameters are to be used as conversion rules, voice conversion is performed by the following mathematical expression:

$$y(i)=a(i)\cdot x(\psi(i)),(0\leqq i<N) \quad (6)$$

where y(i) is a spectral parameter after ith-order conversion, a(i) is a multiplication parameter, ψ(i) is a function representing frequency warping, and x(i) is a source spectral parameter. The function ψ(i) and the parameter a(i) and information used for the selection of a voice conversion rule are stored in the voice conversion rule memory 104. The voice conversion rule generation unit 103 generates pairs of source spectral parameters and target spectral parameters and generates voice conversion rules from the pairs. When LBG clustering is to be performed for source spectral parameters and a conversion rule is to be generated for each cluster, voice conversion rule selection information holds a centroid $c_{sel}$ of a source spectral parameter in each cluster, a frequency warping function ψ in each cluster, and a multiplication parameter a.

Figure 7:
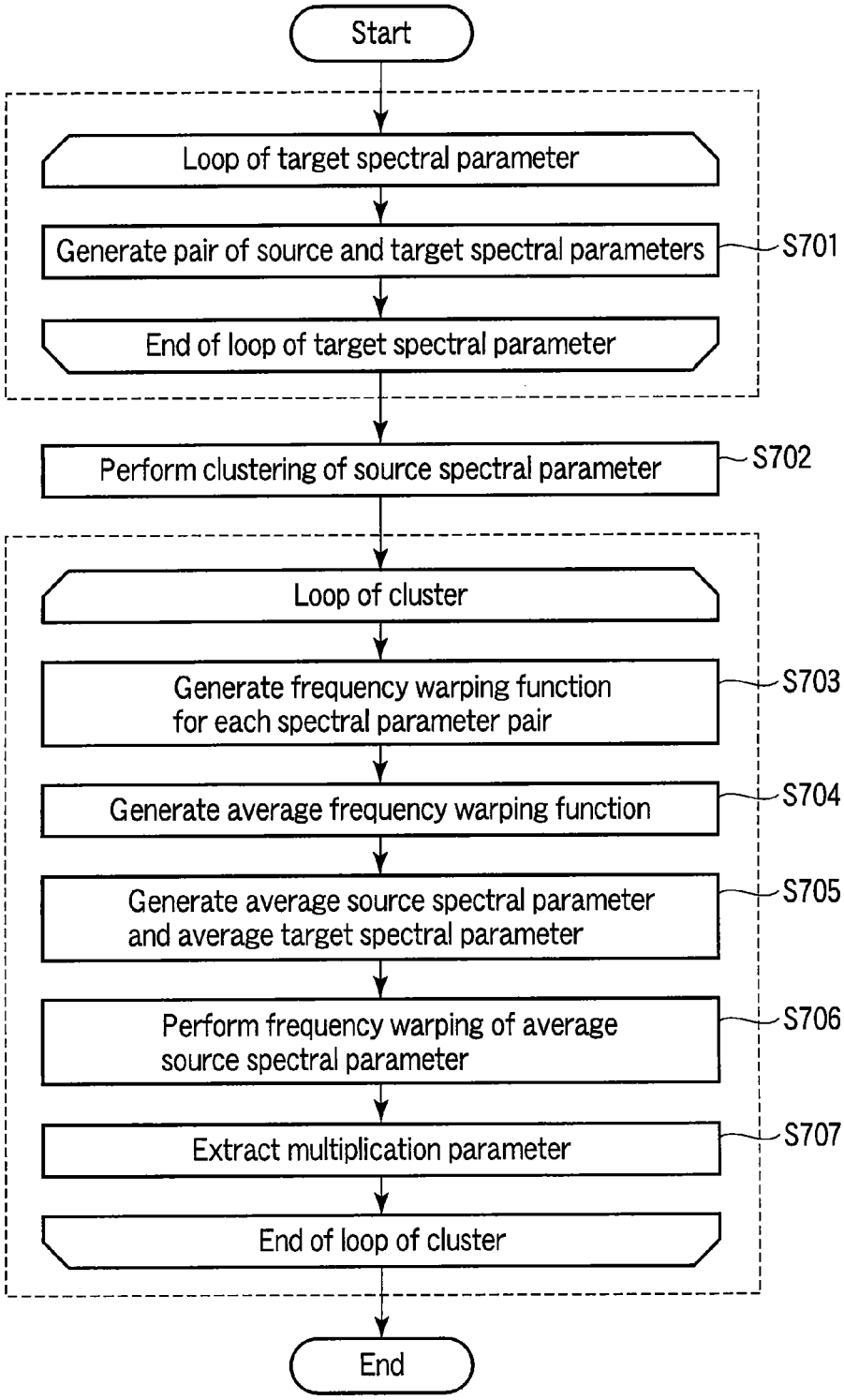
FIG. 7 is a flowchart for explaining the processing operation of a voice conversion rule generation unit.

FIG. 7 is a flowchart for explaining the processing operation of the voice conversion rule generation unit 103. Referring to FIG. 7, the voice conversion rule generation unit 103 selects a source spectral parameter for each target spectral parameter, and obtains a spectral parameter pair (step S701). As a method of obtaining this pair, there is available a method of associating spectral parameters from source speech data and target speech data obtained by the same utterance content. As written in patent reference 2, there is also available a method of segmenting source speech data and target speech data into speech segments for each unit of speech such as a phoneme, half-phoneme, syllable, or diphone, selecting an optimal speech segment from a source speech segment group by using a cost function for each target speech segment, associating the source speech segment with the target speech source, and associating the respective spectra with each other within each speech segment in the time direction.

The voice conversion rule generation unit 103 performs the following processing by using the plurality of spectral parameters obtained in step S701. First of all, in step S702, the voice conversion rule generation unit 103 clusters the respective source spectral parameters of a plurality of pairs. For example, clustering can be classification according to a rule, clustering based on or spectral distances, or clustering based on the generation of a mixture distribution based on a GMM and a decision tree. In the case of classification according to a rule, a classification rule, e.g., classification according to phoneme types or classification based on an articulation method, is set in advance, and clustering is performed in accordance with the rule. In the case of clustering based on spectral distances, an LBG algorithm is applied to source spectral parameters, and clustering is performed based on the Euclidean distances of the spectral parameters, thereby generating the centroid $c_{sel}$ of each cluster. In the case of clustering based on a GMM, the average vector, covariance matrix, and mixing weight of each cluster (mixture) are obtained from learning data based on a likelihood maximization reference. In the case of clustering based on a decision tree, the attribute of each spectral parameter is determined, and a set of questions that segment each attribute into two parts are prepared. Voice conversion rules are generated by sequentially searching for questions that minimize an error. As described above, in the step of clustering source spectral parameters, source spectral parameters are clustered in accordance with a predetermined clustering method. As clustering, LBG clustering based on physical distances is used. It suffices to generate and store a voice conversion rule for each spectral parameter without performing clustering.

For each obtained cluster, the following processing is performed (steps S703 to S707) to generate a voice conversion rule for each cluster.

First of all, in step S703, a frequency warping function is generated for each spectral parameter in each cluster. It is possible to generate a frequency warping function by DP matching between a source spectral parameter and a target spectral parameter. DP matching is a method of associating data strings so as to minimize an error. This method obtains frequency warping function $\psi(i)=j$ which associates an ith-order source spectral parameter with a jth-order target spectral parameter by shifting the ith-order source spectral parameter in the frequency direction. In associating such parameters, giving a constraint on a DP matching path can obtain a warping function under the constraint. For example, giving a constraint concerning a shift width from a frequency warping function generated by using all learning data pairs can generate a stable frequency warping function. It is also possible to obtain a stable frequency warping function by adding, as parameters for DP matching, difference information between adjacent dimensions, the spectral parameters of adjacent frames in the time direction, and the like.

In step S704, the voice conversion rule generation unit 103 obtains an average frequency warping function for each cluster by averaging frequency warping functions corresponding to the respective spectral parameters generated in step S703.

In step S705, in order to obtain a multiplication parameter, the voice conversion rule generation unit 103 obtains an average source spectral parameter and an average target spectral parameter from spectral parameter pairs in each cluster. They are generated by averaging the respective parameters.

In step S706, the voice conversion rule generation unit 103 applies the above average frequency warping function to the obtained average source spectrum to obtain, as a result, the average source spectral parameter to which the resultant frequency warping is applied. In step S707, the voice conversion rule generation unit 103 obtains a multiplication parameter by calculating the ratio between the average target spectral parameter and the average source spectral parameter to which frequency warping is applied.

The voice conversion rule generation unit 103 generates a voice conversion rule by performing the above processing from step S703 to step S707 to each cluster.

Figure 8:
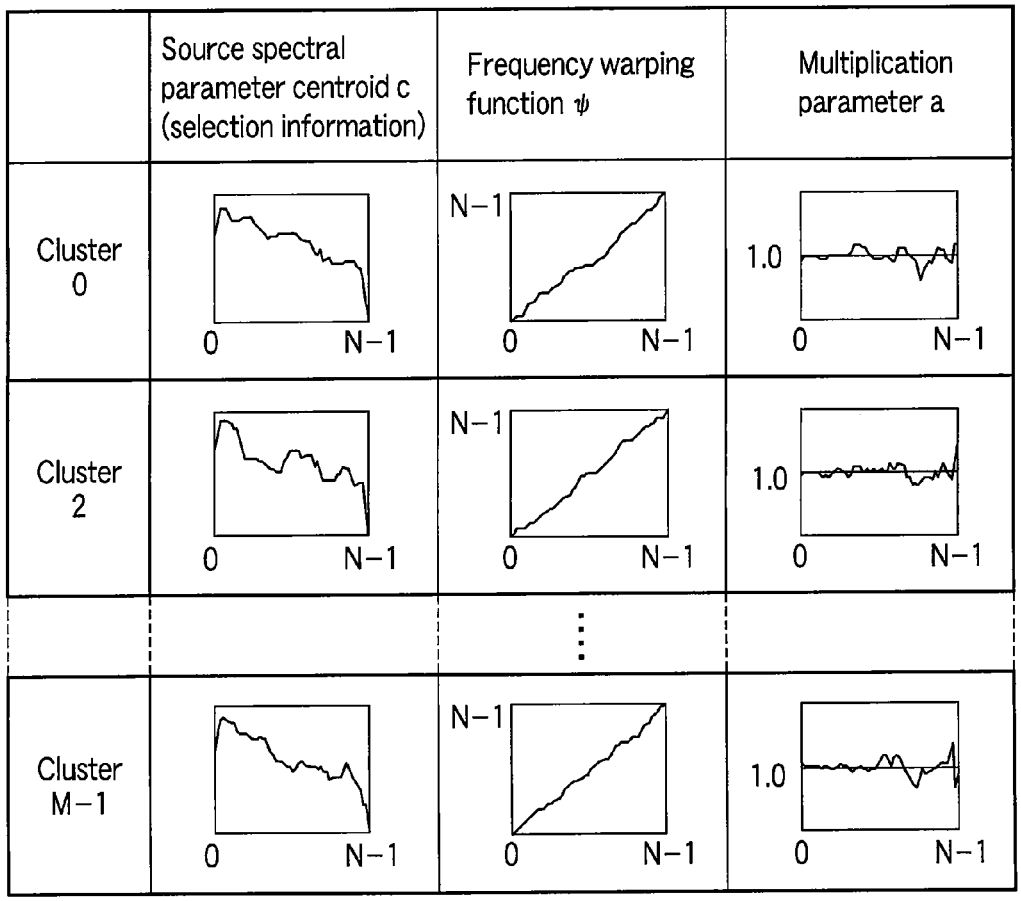
FIG. 8 is a view showing an example of how voice conversion rules are stored in a voice conversion rule memory.

FIG. 8 shows an example of generated voice conversion rules. A voice conversion rule includes the selection information $c_{sel}$, frequency warping function $\psi$, and multiplication parameter for each cluster obtained as a result of clustering. When based on LBG clustering, the selection information $c_{sel}$ is the centroid of the source spectral parameter in the cluster, and becomes a source average spectral parameter like that shown in FIG. 8.

When other clustering methods are to be used, corresponding pieces of selection information are stored. When a GMM is to be used, selection information is a parameter for the GMM. When decision tree clustering is to be used, decision tree information is additionally prepared, and information indicating which cluster corresponds to which leaf node is used as selection information. When a voice conversion rule is to be stored in correspondence with each spectrum pair without clustering, each source spectral parameter is stored as selection information without any change.

As shown in FIG. 8, the frequency warping function $\psi$ is a function representing the dimensional association between parameters with the horizontal axis representing the input and the vertical axis representing the output. As shown in FIG. 8, the multiplication parameter a represents the ratio between the source spectral parameter to which frequency warping is applied and the target spectral parameter. With the above processing, the voice conversion rule generation unit 103 generates the voice conversion rules stored in the voice conversion rule memory 104.

The processing in the voice conversion apparatus which inputs source speech and outputs target speech by using the above voice conversion rules will be described.

Figure 9:
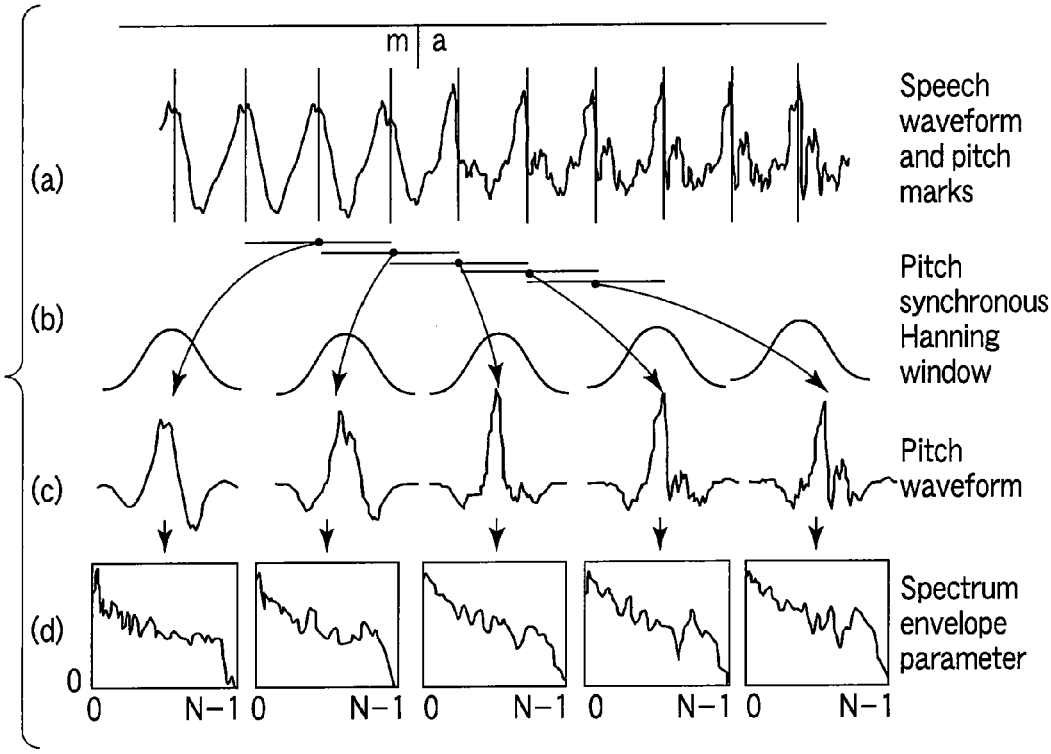
FIG. 9 shows an example of how a source parameter extraction unit adds pitch marks and extracts speech frames.

First of all, as shown in FIG. 9, the source parameter extraction unit 105 extracts a speech frame from source speech (step S201), and further extracts a source spectral parameter (step S202).

In this case, a pitch waveform is used as a speech frame. This apparatus extracts a speech frame from speech data and a corresponding pitch mark. The apparatus extracts a pitch waveform by applying a Hanning window with a length twice as large as the pitch, centered on each pitch mark. That is, the apparatus applies a Hanning window with a length equal to the length of a speech frame used for pitch synchronization analysis (twice as large as the pitch) to the speech waveform of the speech "ma" shown in (a) in FIG. 9, centered on each pitch mark, as shown in (b) in FIG. 9. With this operation, the apparatus obtains a source spectral parameter $s_{src}$ from the extracted pitch waveform ((c) in FIG. 9), as shown in (d) in FIG. 9.

In this embodiment, as shown in FIG. 9, the apparatus extracts a spectral parameter for each pitch waveform of the speech. However, it suffices to perform analysis by using a fixed frame length and frame rate.

The parameter conversion unit 106 generates a first conversion spectral parameter $c_{conv1}$ by converting the source spectral parameter $s_{src}$ obtained in the above manner (steps S203 and S204). First of all, in step S203, the parameter conversion unit 106 selects a voice conversion rule from the voice conversion rules stored in the voice conversion rule memory 104. In this case, the parameter conversion unit 106 obtains the spectral distance between the source spectral parameter $c_{src}$ and the source spectral parameter $c_{sel}$ in each cluster stored as selection information in the voice conversion rule generation unit 103, and selects a cluster k which minimizes the distance.

$$k = \underset{m}{\operatorname{argmin}}(\|c_{src} - c_{sel}^{m}\|^2),\ (0 \le m < M-1) \tag{7}$$

In step S204, the parameter conversion unit 106 obtains the conversion spectral parameter $c_{conv1}$ by actually converting the spectrum $c_{src}$ by using a frequency warping function $\psi_k$ and multiplication parameter $a_k$ of the selected cluster k.

$$c_{conv1}(i)=a_k(i)\cdot c_{src}(\psi_k(i)),(0\leqq i<N) \tag{8}$$

Figure 10:
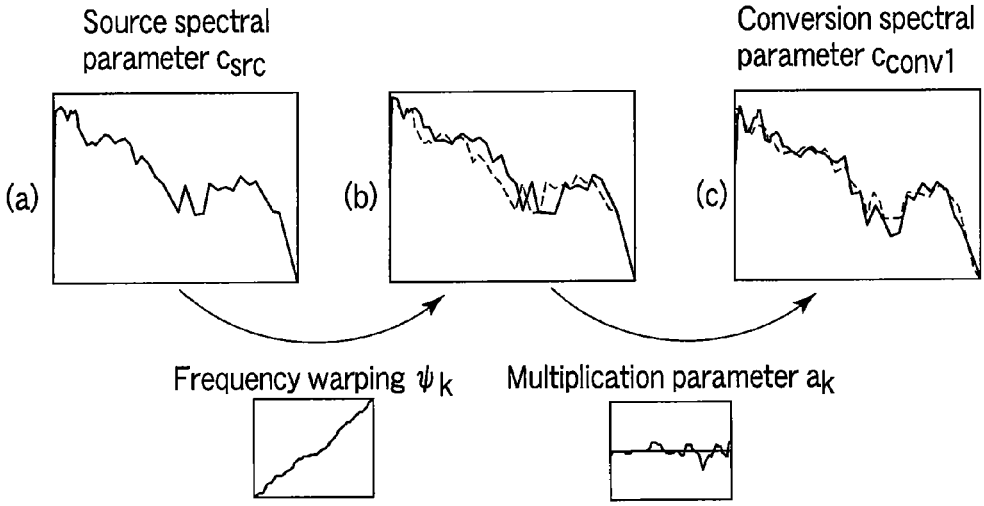
FIG. 10 shows an example of how a parameter conversion unit performs voice conversion of a spectral parameter.

FIG. 10 shows this state. First of all, the parameter conversion unit 106 obtains a source spectral parameter after frequency warping by applying a frequency warping function $\phi_k$ to the source spectral parameter $c_{src}$ shown in (a) in FIG. 10. This processing is to shift the spectral parameter in the spectral region in the frequency direction. Referring to (b) in FIG. 10, the dotted line represents the parameter $s_{src}$, and the solid line represents the spectral parameter after frequency warping, thus providing a clear understanding of this state. The parameter conversion unit 106 then obtains the first conversion spectral parameter $c_{conv1}$ by multiplying the spectral parameter after frequency warping by the multiplication parameter $a_k$, as shown in (c) in FIG. 10.

In a speech spectrum, a formant frequency, which is a resonance frequency in the vocal tract, is important information indicating differences in phonetic characteristics and speaker characteristics. Frequency warping mainly indicates the processing of moving this formant frequency. It is known that converting a formant frequency will change the voice quality. In addition, the parameter conversion unit 106 adjusts the shape of the spectral parameter after conversion by converting the value (coefficient value) in the amplitude direction using the multiplication parameter, thereby obtaining the first target spectral parameter.

The above conversion method has a characteristic that it clarifies a physical meaning, as compared with conversion by regression analysis on a cepstrum. The parameter conversion unit 106 obtains the first conversion spectral parameter at each time by applying the above processing to the spectral parameter obtained from each speech frame of input source speech.

In step S205, the parameter selection unit 107 calculates the similarity between the first conversion spectral parameter $c_{conv1}$ obtained for each speech frame and each target spectral parameter stored in the target parameter memory 102. In step S206, the parameter selection unit 107 selects a target spectral parameter $c_{tgt}$ most similar (exhibiting the highest similarity) to each first conversion spectral parameter. When a spectral distance is to be used as a similarity, the parameter selection unit 107 obtains the Euclidean distance between spectral parameters and selects a target spectral parameter which minimizes the distance. It suffices to use, as a similarity, a cost function representing a difference in attribute such as $f_0$ or phonetic environment instead of a spectral distance. In this manner, the parameter selection unit 107 selects a target spectral parameter.

According to the above description, the parameter selection unit 107 selects one target spectral parameter for one first spectral parameter. However, the present invention is not limited to this. It suffices to select a plurality of target spectral parameters for one first conversion spectral parameter. In this case, the parameter selection unit 107 selects a plurality of target spectral parameters in descending order of similarity (distance).

The aperiodic component generation unit 108 separates the target spectral parameter selected by the parameter selection unit 107 into a periodic component and an aperiodic component. First of all, in step S207, the aperiodic component generation unit 108 calculates and determines a parameter necessary to segment a spectrum into a periodic component and an aperiodic component. When segmenting a spectral parameter into a high-frequency component and a low-frequency component, the aperiodic component generation unit 108 obtains a boundary frequency at the boundary between the periodic component and aperiodic component of voice quality.

The aperiodic component generation unit 108 can obtain the above boundary frequency from the target spectral parameter selected by the parameter selection unit 107 or the first conversion spectral parameter. That is, when determining a boundary frequency based on a cumulative value in the linear amplitude region of a spectral parameter, the aperiodic component generation unit 108 obtains the cumulative value of amplitudes for the respective frequencies throughout the entire frequency band, i.e., a cumulative value cum in the linear region.

$$cum = \sum_{p=0}^{N} \sqrt{\exp(c_{tgt}(p))} \tag{9}$$

In addition, the aperiodic component generation unit 108 determines a predetermined ratio $\lambda \cdot cum$ of the cumulative value cum of amplitudes in the entire frequency band by using the obtained cumulative value cum and a predetermined coefficient $\lambda$ (<1). The aperiodic component generation unit 108 then accumulates amplitudes for each frequency in ascending order of frequency, and obtains a frequency (order) q at which the cumulative value becomes a maximum value equal to or less than $\lambda \cdot cum$ according to Equation 10. The value of q is a boundary frequency.

$$q = \underset{P}{\operatorname{argmax}}\left\{\sum_{p=0}^{P} \sqrt{\exp(c_{tgth}(p))} < \lambda \cdot cum\right\} \tag{10}$$

With the above processing, the aperiodic component generation unit 108 can obtain the boundary frequency q. In step S208, the aperiodic component generation unit 108 obtains an aperiodic component spectral parameter $c_h$ by actually separating the spectral parameter.

$$c_h(p) = \begin{cases} 0 & (0 \le p < q) \\ c_{tgt}(p) & (q \le p < N) \end{cases} \tag{11}$$

As indicated by Equation 11, it suffices to obtain the aperiodic component spectral parameter $c_h$ by setting the low frequency to "0" or to smoothly have a value by applying a monotonically increasing weight to near the boundary.

When the parameter selection unit 107 has selected a plurality of target spectral parameters, the aperiodic component generation unit 108 obtains the parameter $c_{tgt}$ by averaging the plurality of selected target spectral parameters, and obtains a boundary frequency in the same manner as in the above processing. It suffices to generate the parameters $c_{tgt}$ and $c_h$ by applying processing with an auditory weighting filter, valley enhancement processing for spectral parameters, or the like after averaging.

Figure 11:
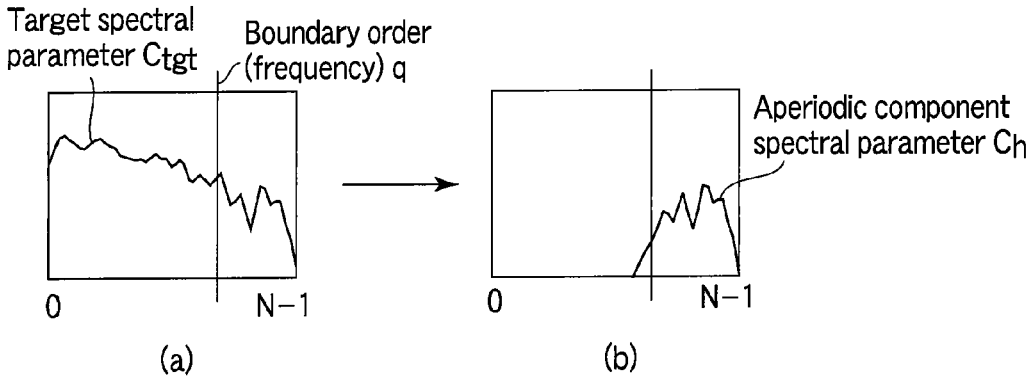
FIG. 11 explains a method of generating an aperiodic component spectral parameter in an aperiodic component generation unit.

FIG. 11 shows how the parameter $c_h$ is generated by segmenting the selected target spectral parameter $c_{tgt}$, in which (a) in FIG. 11 shows the selected target spectral parameter, and (b) in FIG. 11 shows the obtained aperiodic component spectral parameter. As shown in FIG. 11, the spectral parameter is segmented into a high-frequency component and a low-frequency component to obtain an aperiodic component and a periodic component.

Figure 12:
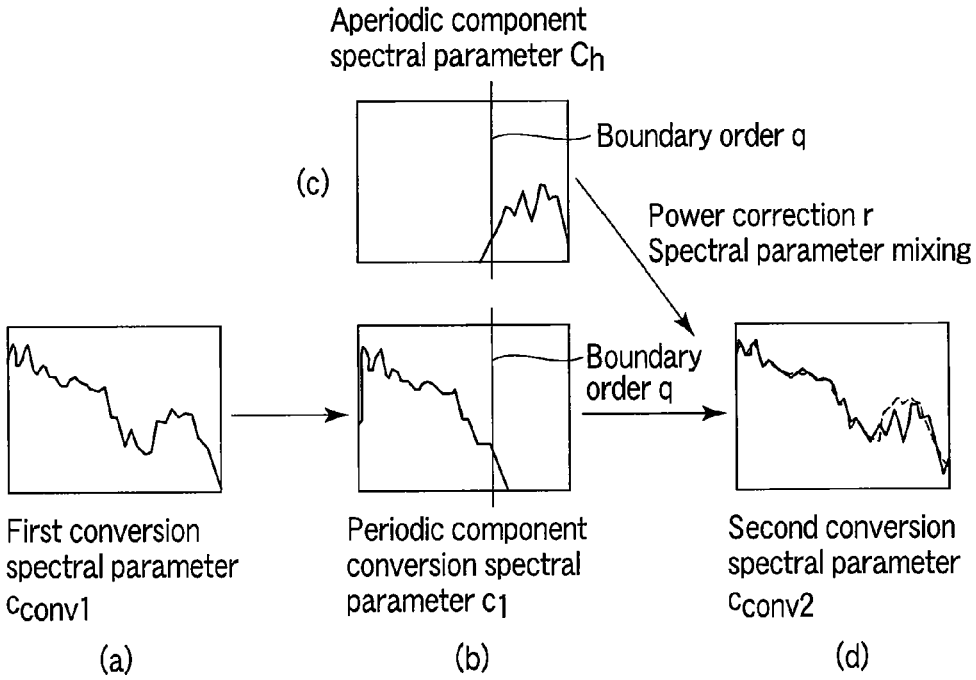
FIG. 12 explains a method of generating the second conversion spectral parameter in a parameter mixing unit.

As shown in FIG. 12, the parameter mixing unit 109 generates a periodic component spectral parameter $c_1$ (see (b) in FIG. 12) from the first conversion spectral parameter $c_{conv1}$ (see (a) in FIG. 12) obtained by the parameter conversion unit 106, and obtains a second conversion spectral parameter $c_{conv2}$ by mixing the spectral parameter $c_1$ with the aperiodic component spectral parameter $c_h$ (see (c) in FIG. 12) obtained by the aperiodic component generation unit 108 (see (d) in FIG. 12).

Assume that a spectral parameter is to be segmented into a high-frequency component and a low-frequency component. In this case, in step S209, a boundary order q obtained by the aperiodic component generation unit 108 is used to segment the spectral parameter into a low-frequency portion smaller than the boundary order q of the first conversion spectral parameter and a high-frequency portion equal to or more than the boundary order q, as indicated by Equation 12 given below. This low-frequency portion is set as the periodic component conversion spectral parameter $c_1$.

$$c_1(p) = \begin{cases} c_1(p) & (0 \le p < q) \\ 0 & (q \le p < N) \end{cases} \tag{12}$$

In step S210, the parameter mixing unit 109 obtains the second conversion spectral parameter $c_{conv2}$ by mixing the periodic component conversion spectral parameter $c_1$ with the aperiodic component spectral parameter $c_h$.

As described above, "mixing" performed by the parameter mixing unit 109 is to generate the second conversion spectral parameter by replacing the high-frequency portion higher than the boundary order q of the first conversion spectral parameter by the aperiodic component generated by the aperiodic component generation unit 108.

The parameter mixing unit 109 may mix parameters upon power adjustment. In this case, the parameter mixing unit 109 obtains a power $p_{conv1}$ of the first conversion spectral parameter and a power $p_{tgt}$ of a target spectral parameter, obtains a power correction amount t from their ratio, and mixes the aperiodic component spectral parameter with the periodic component conversion spectral parameter upon power adjustment.

$$c_{conv}(p) = c_1(p) + rc_h(p),\ r = \sqrt{\frac{P_{conv1}}{P_{tgt}}} \tag{13}$$

The waveform generation unit 110 generates a speech waveform from the second conversion spectral parameter $c_{conv2}$. In step S211, the waveform generation unit 110 generates pitch waveforms from the parameter $c_{conv2}$. In step S212, the waveform generation unit 110 generates a speech waveform by superimposing/concatenating the waveforms in accordance with pitch marks. The waveform generation unit 110 generates a spectral parameter from the parameter $c_{conv2}$ by using Equation 5, and generates a speech waveform by performing inverse Fourier transform upon giving a proper phase. This makes it possible to obtain voice-converted speech.

Figure 13:
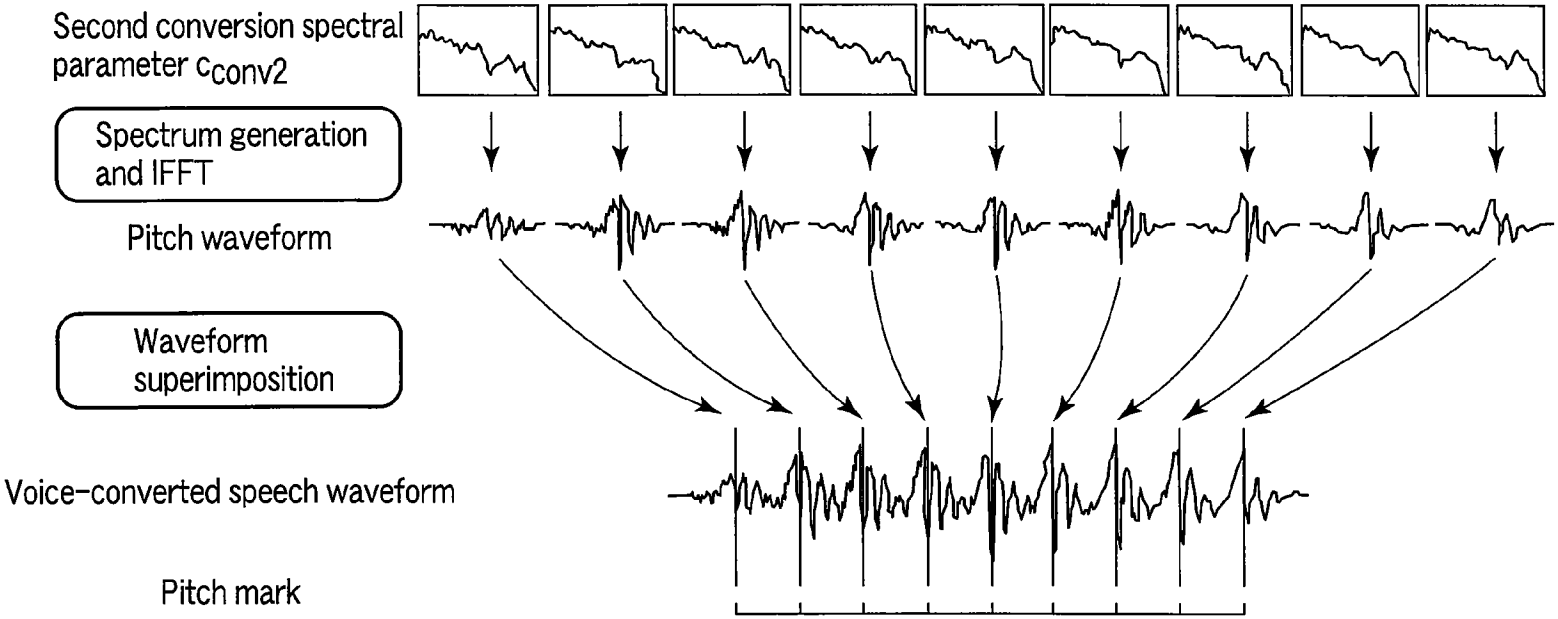
FIG. 13 is a view for explaining processing in a waveform generation unit.

As shown in FIG. 13, the waveform generation unit 110 generates a discrete spectrum from each second conversion spectral parameter $c_{conv2}$, generates pitch waveforms by performing IFFT, and generates a voice-converted speech waveform by superimposing the waveforms in accordance with pitch marks.

Although phase information is required for the generation of a pitch waveform, the waveform generation unit 110 obtains a phase parameter from a parameter based on a local-band base, and separates phase spectral information into a periodic component and an aperiodic component by using the boundary order obtained by Equation 10. It is possible to generate a pitch waveform by mixing a periodic component and an aperiodic component using a source phase parameter for the periodic component and using a phase parameter of a selected source spectral parameter for the aperiodic component. Letting arg(X(k)) be an unwrapped phase spectrum, a phase parameter $h_i$ is obtained by $$\arg(X(k)) = \sum_{i=0}^{N-1} h_i \phi_i(k),\ (0 \le k < L) \tag{14}$$

Figure 14:
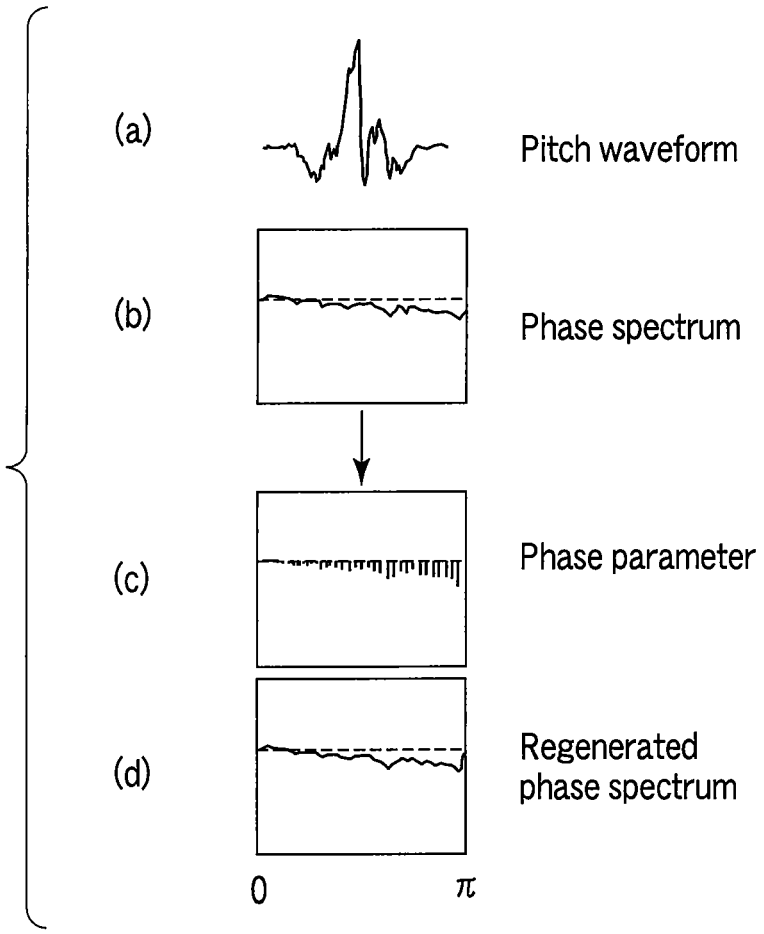
FIG. 14 explains a phase parameter.

A phase spectrum used for the generation of a pitch waveform by the waveform generation unit 110 is generated by using the phase parameter obtained in this manner. FIG. 14 shows an example of how a phase spectral parameter is extracted, in which (a) in FIG. 14 shows the pitch waveform of a source speech frame, (b) in FIG. 14 shows the phase spectrum (unwrapped phase) of each pitch waveform, (c) in FIG. 14 shows a phase parameter obtained from each phase spectrum, and (d) in FIG. 14 shows a phase spectrum regenerated by Equation 14.

Figure 15:
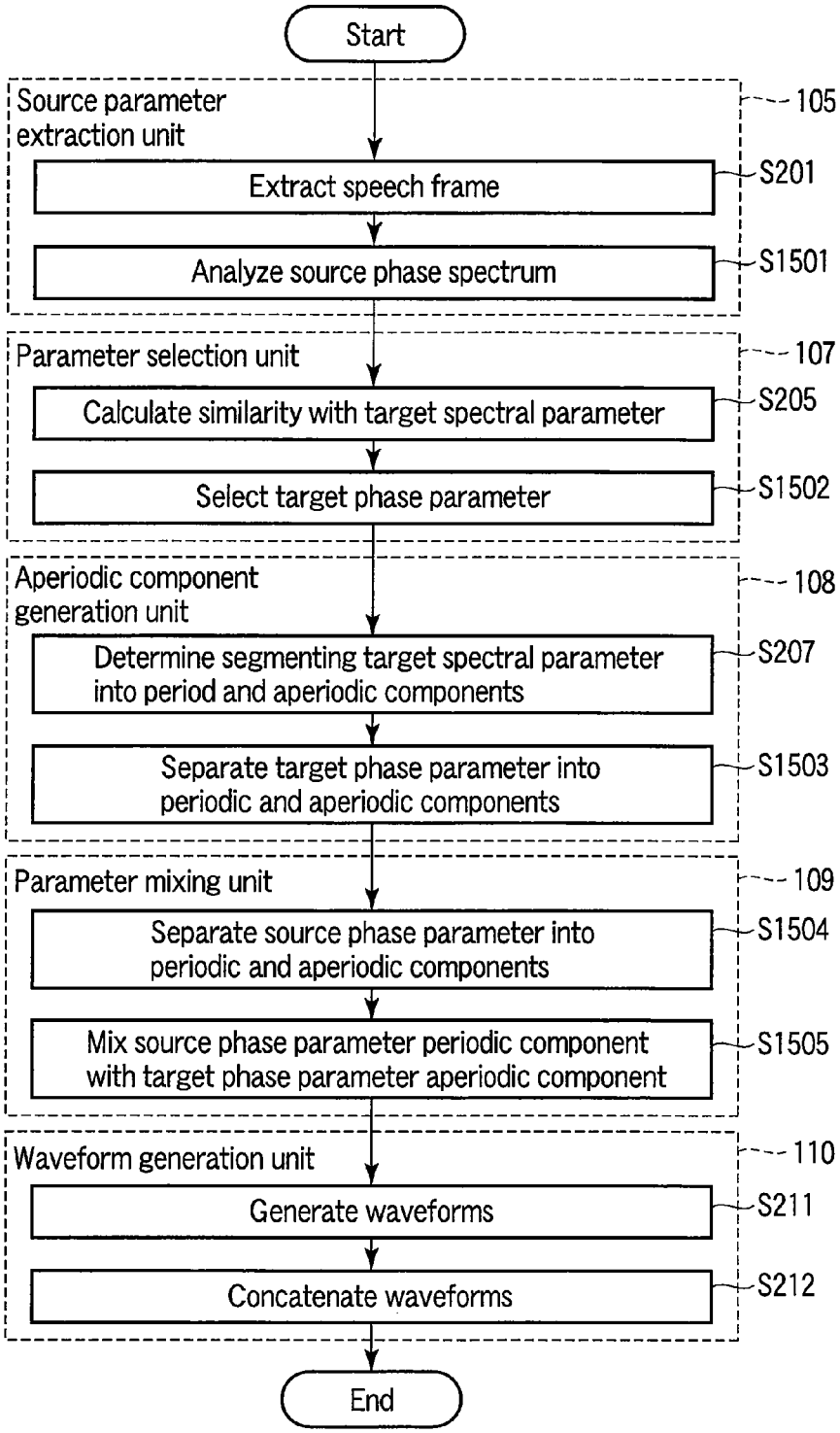
FIG. 15 is a flowchart for explaining the phase parameter generation operation of the voice conversion apparatus in FIG. 1.

FIG. 15 shows phase spectrum generation operation. Note that the same reference numerals as in FIG. 15 denote the same parts in FIG. 2.

Upon extracting a speech frame from source speech in step S201, the source parameter extraction unit 105 extracts a phase spectrum and a phase parameter representing the characteristic of the spectrum, as shown in FIG. 14.

Note that a phase parameter obtained from target speech is stored in the target parameter memory 102 as in the case of the above source speech. This phase parameter is stored in the target parameter memory 102 in correspondence with the corresponding target spectral parameter and selection information.

Figure 2:
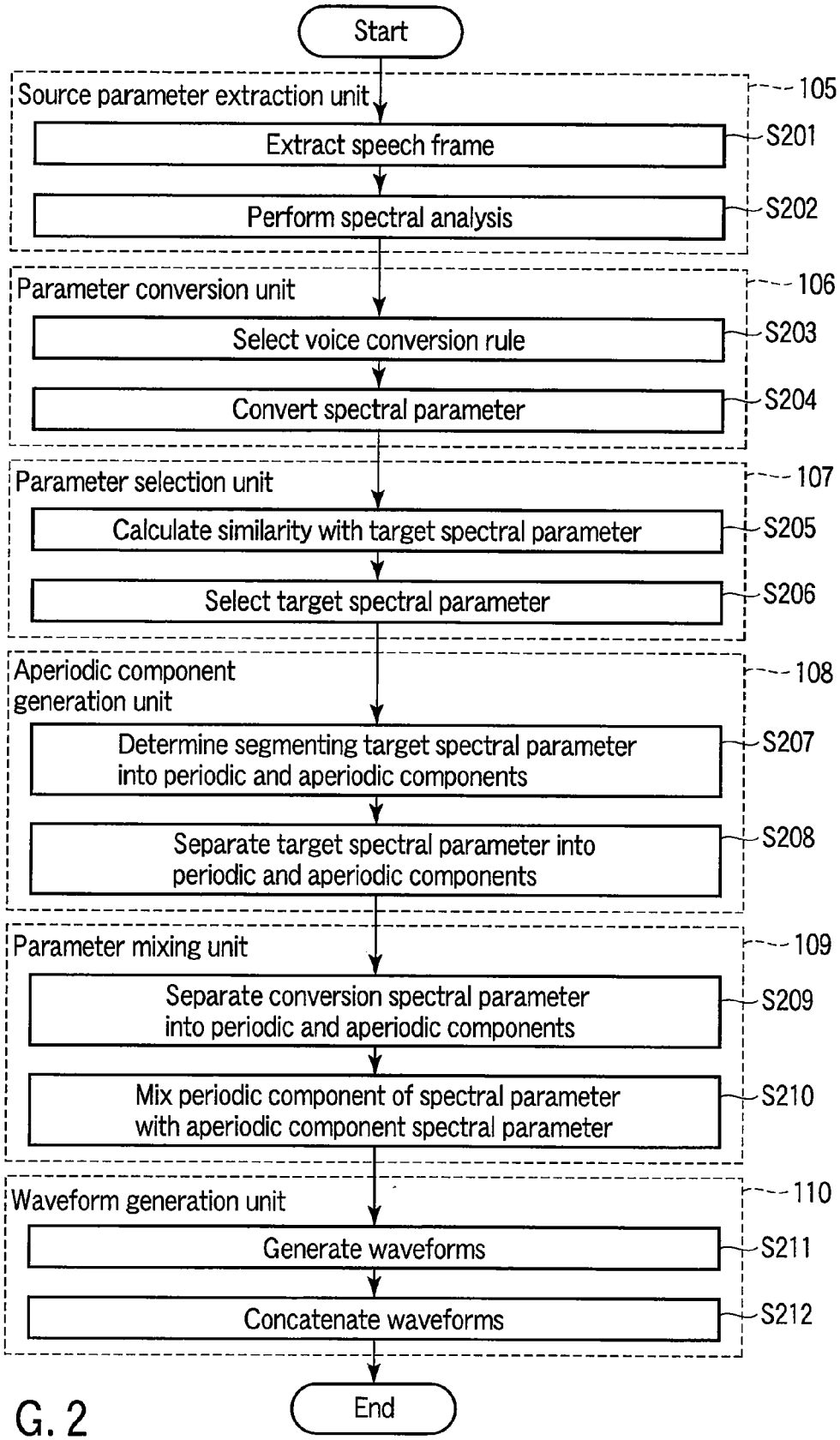
FIG. 2 is a flowchart for explaining the processing operation of the voice conversion apparatus in FIG. 1.

When the first conversion spectral parameter is generated in steps S203 and S204 in FIG. 2, the parameter selection unit 107 obtains the similarity between the obtained first conversion spectral parameter and each target spectral parameter stored in the target parameter memory 102 in step S205, as described above. The parameter selection unit 107 selects one or a plurality of target spectral parameters in descending order of similarity in step S206 in FIG. 2. At this time, the parameter selection unit 107 selects a phase parameter (target phase parameter) stored in the target parameter memory 102 in correspondence with the selected target spectral parameter.

The aperiodic component generation unit 108 then obtains the boundary order q for segmenting a phase parameter into a periodic component and an aperiodic component in step S207. In step S1503, the aperiodic component generation unit 108 separates the target phase parameter into a periodic component and an aperiodic component by using the obtained boundary order q to obtain an aperiodic component $h_h$. Extracting a band above the boundary order q as indicated by Equation 11 can obtain the aperiodic component $h_h$.

As described above, the parameter mixing unit 109 separates the first conversion spectral parameter into a periodic component and an aperiodic component to extract the periodic component of the first conversion spectral parameter. The parameter mixing unit 109 then generates the second conversion spectral parameter by mixing the extracted periodic component of the first conversion spectral parameter with the aperiodic component spectral parameter. In step S1504, the parameter mixing unit 109 obtains a periodic component phase parameter $h_1$ by extracting a low-frequency component from the source phase parameter obtained in step S1501 as indicated by Equation 12. In step S1505, the parameter mixing unit 109 obtains the conversion phase parameter $h_i$ by mixing the obtained periodic component phase parameter $h_1$ with the aperiodic component phase parameter $h_h$, and generates a phase spectrum from the obtained parameter $h_i$ by using Equation 14.

The obtained phase spectrum is used when the waveform generation unit 110 generates a pitch waveform in step S211.

As described above, a periodic component (which naturally changes) corresponding to the low-frequency portion of a phase spectrum used for the generation of the speech waveform of converted speech is generated from a phase parameter obtained from input source speech. Since the aperiodic component of the target phase parameter is used as the high-frequency portion, natural converted speech can be obtained.

In the above embodiment, as a conversion rule, voice conversion based on LBG clustering for source speech is used. However, the present invention is not limited to this.

It is possible to perform voice conversion by storing, in the voice conversion rule memory 104 in advance, frequency warping functions and multiplication parameters corresponding to source and target spectral parameter pairs generated as learning data, and selecting a voice conversion rule from the stored data. In this case, in step S203, the parameter conversion unit 106 selects one or a plurality of voice conversion rules for each source spectrum based on similarities. The one selected voice conversion rule or an average voice conversion rule generated from a plurality of voice conversion rules can be used for voice conversion. When averaging a plurality of selected voice conversion rules, the parameter conversion unit 106 can perform voice conversion by obtaining an average frequency warping function and an average multiplication parameter by averaging the frequency warping functions $\psi$ and the multiplication parameters a. With this operation, a proper voice conversion rule can be generated from various conversion rules prepared in advance by selecting a proper conversion rule or averaging a plurality of neighboring conversion rules. This allows the voice conversion apparatus according to this embodiment to perform spectrum conversion of a periodic component with high quality.

The above voice conversion apparatus uses spectral parameters based on local-band bases. However, this apparatus can perform similar processing by using discrete spectra obtained by FFT. In this case, the source parameter memory 101 and the target parameter memory 102 respectively store discrete spectra obtained by FFT or the like, and the source parameter extraction unit 105 obtains a discrete spectrum in step S202. Thereafter, the apparatus converts the spectrum by using a frequency warping function and a multiplication parameter. The apparatus then generates a waveform by mixing the periodic component of the converted spectrum with the spectrum of a selected target aperiodic component, thereby generating converted speech. Likewise, as a phase, a phase parameter based on a discrete spectrum can be used.

In addition, the voice conversion apparatus according to this embodiment can use various spectrum conversion methods and spectral parameters as well as the above scheme. A method based on difference parameters and a method using regression analysis based on a GMM described in non-patent reference 1 will be described below as other spectrum conversion methods. In this case, it is possible to use, as a spectral parameter, a spectral parameter such as a cepstrum, a mel-cepstrum, or an LSP as well as a parameter in a frequency domain such as a parameter based on the above local-band base or a discrete spectrum.

When performing voice conversion by using difference parameters, the parameter conversion unit 106 performs voice conversion by using Equation 15 instead of Equation 6.

$$y=x+b \tag{15}$$

where y is a spectral parameter after conversion, b is a difference parameter, and x is a source spectral parameter. The difference parameter b and information (selection information) used for the selection of a voice conversion rule are stored in the voice conversion rule memory 104. The voice conversion rule generation unit 103 generates a voice conversion rule as in the case of conversion based on frequency warping and a multiplication parameter.

The voice conversion rule generation unit 103 generates a plurality of pairs of source spectral parameters and target spectral parameters and generates a difference parameter from each pair. When a plurality of difference parameters are to be stored upon clustering, the voice conversion rule generation unit 103 can generate a conversion rule for each cluster upon LBG clustering of source spectra in the same manner as described above. The voice conversion rule memory 104 stores the centroid $c_{sel}$ of a source spectrum in each cluster, which is selection information for a voice conversion rule, and the difference parameter b in each cluster.

The parameter conversion unit 106 obtains the first conversion spectral parameter $c_{conv1}$ by converting the source spectral parameter $c_{src}$. First of all, in step S203, the parameter conversion unit 106 obtains the spectral distance between the source spectral parameter $s_{src}$ and the centroid $c_{sel}$ of a source spectrum in each cluster, stored as selection information in the voice conversion rule memory 104, and selects the cluster k corresponding to the minimum spectral distance. In step S204, the parameter conversion unit 106 then converts the source spectral parameter $c_{src}$ into the first conversion spectral parameter $c_{conv1}$ by using a difference parameter $b_k$ in the selected cluster k.

$$c_{conv1}=c_{src}+b_k \tag{16}$$

When using a voice conversion rule based on a regression analysis parameter, the parameter conversion unit 106 performs voice conversion according to Equation 17.

$$y=Ax+b \tag{17}$$

In this case as well, it is possible to generate a voice conversion rule for each cluster by clustering source spectral parameters. The parameter conversion unit 106 generates regression analysis parameters A and b from a pair of a source spectral parameter in each cluster and a target spectral parameter, and stores the parameters in the voice conversion rule generation unit 103. The parameter conversion unit 106 performs conversion according to Equation 18 after determining the cluster k.

$$c_{conv1}=A_k c_{src}+b_k \tag{18}$$

A case in which a voice conversion rule using regression analysis based on a GMM is used will be described next. In this case, a source speaker spectral parameter is modeled by a GMM, and voice conversion is performed with weighting operation based on the posterior probability that the input source speaker spectral parameter is observed in each mixture component of the GMM. A Gaussian distribution mixture GMM$\lambda$ is represented by $$p(x \mid \lambda) = \sum_{c=1}^{C} w_C\, p(x \mid \lambda_C) = \sum_{c=1}^{C} w_C N(x \mid \mu_C, \Sigma_C) \tag{19}$$

where p represents a likelihood, c represents a mixture, $w_c$ represents a mixture weight, and $P(x|\lambda_c)=N(x|\mu_c, \Sigma_c)$ represents the likelihood of the Gaussian distribution of an average $\mu_c$ and variance $\Sigma_c$ in the mixture c.

In this case, a voice conversion rule based on the GMM is represented by $$y' = \sum_{c=1}^{C} p(m_C \mid x)\{A^C x' + b^C\} \tag{20}$$

where $A^c$ and $b^c$ are regression analysis parameters for each mixture, and $p(m_c|x)$ is the probability that x is observed in the mixture $m_c$, which is obtained by $$p(m_C \mid x) = \frac{w_C p(x \mid \lambda_C)}{p(x \mid \lambda)} \tag{21}$$

Figure 16:
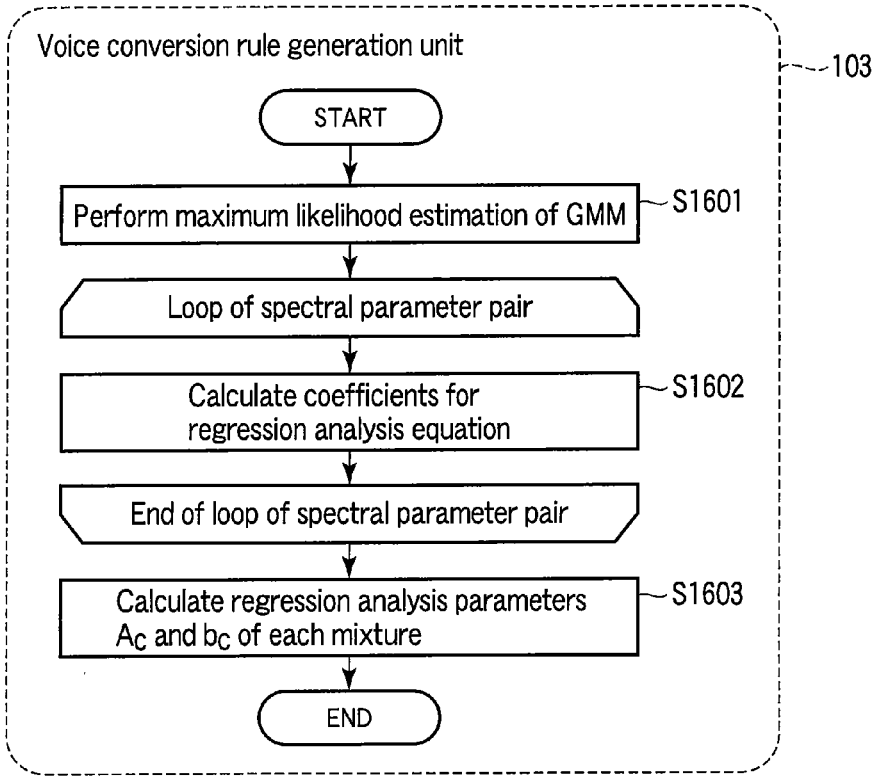
FIG. 16 is a flowchart for explaining another processing operation of the voice conversion rule generation unit.

Voice conversion based on a GMM is characterized in that a regression matrix continuously changes between mixtures. In voice conversion based on a GMM, each cluster corresponds to each mixture of the GMM, and each mixture is represented by a Gaussian distribution. That is, the average $\mu_c$, variance $\Sigma_c$, and mixture weight $w_c$ of each mixture are stored as conversion rule selection information in the voice conversion rule memory 104. Letting $\{A^c, b^c\}$ be a regression analysis parameter for each mixture, x is converted so as to weight the regression matrix of each mixture based on the posterior probability given by Equation 21. FIG. 16 shows the processing operation of the voice conversion rule generation unit 103 in the case of regression analysis based on a GMM.

First of all, in step S1601, the voice conversion rule generation unit 103 performs maximum likelihood estimation of a GMM. The voice conversion rule generation unit 103 performs maximum likelihood estimation of each parameter of a GMM by giving a cluster generated by an LBG algorithm as the initial value of a GMM and using an EM algorithm. In step S1602, the voice conversion rule generation unit 103 obtains coefficients for an equation for obtaining a regression matrix. In step S1603, the voice conversion rule generation unit 103 obtains a regression matrix $\{A_c, b_c\}$ of each mixture. In voice conversion using regression analysis based on a GMM, a model parameter λ of the GMM and the regression matrix $\{A_c, b_c\}$ of each mixture are stored as voice conversion rules in the voice conversion rule memory 104. Setting $x=c_{src}$, the parameter conversion unit 106 calculates a probability by using a source spectrum and a model parameter for the GMM, which is stored in the voice conversion rule memory 104, according to Equation 21, converts the spectrum by Equation 20, and uses an obtained value y as the first conversion spectral parameter $c_{conv1}$.

It is possible to use, as spectral parameters, various parameters, e.g., cepstrums, mel-cepstrums, LSP parameters, discrete spectra, and parameters based on the above local-band bases. Although voice conversion using a frequency warping function and a multiplication parameter expressed by Equation 6 is assumed to use parameters in the frequency domain, arbitrary spectral parameters can be used when voice conversion using regression analysis based on difference parameters, regression analysis parameters, and a GMM.

When parameters different from parameters in the frequency domain are to be used, it is often difficult to directly separate a spectral parameter into a periodic component and an aperiodic component. In this case, the aperiodic component generation unit 108 and the parameter mixing unit 109 convert the target spectral parameter selected by the parameter selection unit 107 or the first conversion spectral parameter into a discrete spectrum, and uses the obtained discrete spectrum as a spectral parameter for periodic/aperiodic component separation. The second conversion spectral parameter can be obtained by mixing the aperiodic component of the target spectral parameter represented by the discrete spectrum as an aperiodic component spectral parameter with the periodic component of the first conversion spectral parameter represented by the discrete spectrum as a periodic component conversion spectral parameter.

Figure 17:
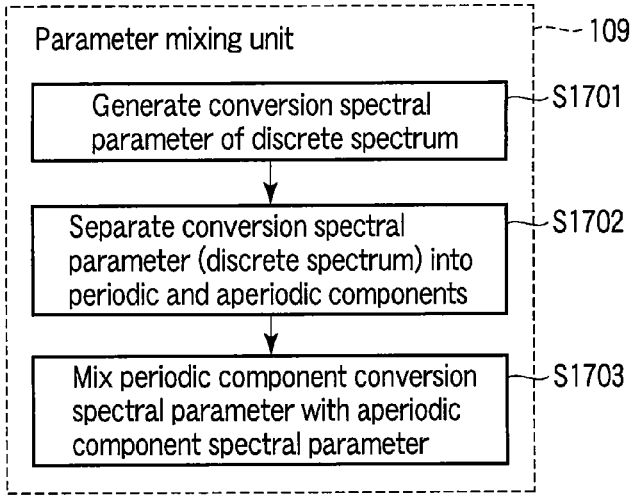
FIG. 17 is a flowchart for explaining another processing operation of the parameter mixing unit.

In this case, as shown in FIG. 17, in step S1701, the parameter mixing unit 109 obtains the first conversion spectral parameter of a discrete spectrum by converting the first conversion spectral parameter obtained by the parameter conversion unit 106 into a discrete spectrum. If a cepstrum and a mel-cepstrum are used as spectral parameters, it is possible to obtain a discrete spectrum as indicated by Equation 22.

$$X(\tilde{\Omega}) = \sum_{n=0}^{N} c(m)\cos(\tilde{\Omega}m), \quad \tilde{\Omega} = \Omega + 2\tan^{-1}\frac{\alpha\sin\Omega}{1-\alpha\cos\Omega} \tag{22}$$

When an LSP parameter is used, a discrete spectrum can be obtained according to Equation 23:

$$X(\Omega) = \frac{2^{1-p}}{\left\{\begin{array}{l}\sin^2\frac{\Omega}{2}\prod_{m=even}(\cos\Omega - \cos c(m))^2 + \\ \cos^2 + \frac{\Omega}{2}\prod_{m=odd}(\cos\Omega - \cos c(m))^2\end{array}\right\}^2} \tag{23}$$

When other spectral parameters are used instead, a discrete spectrum is generated from the first conversion spectral parameter, and the first conversion spectral parameter for the discrete spectrum is obtained.

In step S1702, the parameter mixing unit 109 separates the obtained first conversion spectral parameter for the discrete spectrum into a periodic component and an aperiodic component, and extracts the periodic component. When using the boundary order q obtained from the cumulative value of spectral amplitudes in a linear region represented by Equation 10, as described in the above embodiment, the parameter mixing unit 109 extracts a discrete spectral component lower than q as a periodic component, and generates a periodic component conversion spectral parameter.

In step S1703, the parameter mixing unit 109 obtains the second conversion spectral parameter by mixing the periodic component conversion spectral parameter extracted in this manner with the aperiodic component spectral parameter. When the target spectral parameters stored in the target parameter memory 102 are parameters such as cepstrums or LSP parameters, it is also possible to extract an aperiodic component spectral parameter after the aperiodic component generation unit 108 converts a spectral parameter into a discrete spectrum.

This makes it possible to use the voice conversion apparatus based on this embodiment by using arbitrary spectral parameters.

In the above embodiment, a spectrum is separated into a periodic component and an aperiodic component based on the cumulative value of spectral amplitudes. However, the present invention is not limited to this. The embodiment can use a method of segmenting a frequency domain used for MELP (Mixed Excitation Linear Prediction) into a plurality of bands, determining the periodicity/aperiodicity of each band, and separating a periodic component and an aperiodic component upon obtaining their boundary on the basis of the determination result, a separation method using, as a boundary frequency, the maximum voiced frequency obtained by the method used for an HNM (Harmonic plus Noise Model), a method of segmenting a spectrum into a periodic component and an aperiodic component by generating the aperiodic component from a spectral component other than an integer multiple of the fundamental frequency and generating the periodic component from a spectral component corresponding to an integer multiple of the fundamental frequency upon performing DFT of a speech waveform with a window width of an integer multiple of a pitch by using a PSHF (Pitch Scaled Harmonic Filter), or the like.

When a spectrum is to be separated into a periodic component and an aperiodic component by the MELP method, a speech signal is divided into bands by using a predetermined band division filter, and a value representing the degree of periodicity in each band is calculated. A value representing the degree of periodicity is determined by the correlation of a speech signal having a width corresponding to a pitch length.

$$c_t = \frac{\sum_{n=0}^{N-1} s_n s_{n+t}}{\sqrt{\sum_{n=0}^{N-1} s_n s_n \sum_{n=0}^{N-1} s_{n+t} s_{n+t}}} \tag{24}$$

If a value representing the above degree of periodicity is equal to or more than a predetermined threshold, the corresponding band is determined as a periodic component. Otherwise, the corresponding band is determined as an aperiodic component. The boundary between the frequency band determined as the periodic component and the frequency band determined as the aperiodic component is set as a boundary frequency.

The aperiodic component generation unit 108 obtains boundary frequency information calculated based on the above index for the target spectral parameter selected by the parameter selection unit 107, and generates an aperiodic component spectral parameter by band division of the target spectral parameter on the basis of the boundary frequency information. The parameter mixing unit 109 obtains the first conversion spectral parameter in a band equal to or less than the obtained boundary frequency as a periodic component conversion spectral parameter, and obtains the second conversion spectral parameter by mixing the obtained parameter with the above aperiodic component spectral parameter.

Assume that the maximum voiced frequency used for an HNM is used as the boundary between a periodic component and an aperiodic component. In this case, the cumulative value of amplitudes between each maximum peak $f_c$ near a position corresponding to an integer multiple of $f_0$ and an adjacent valley is obtained as $Amc(f_c)$, and a periodic component and an aperiodic component are discriminated from each other based on the ratio between the cumulative value $Amc(f_c)$ and the average value of cumulative values $Amc(f_i)$ of adjacent peaks, the difference between a value $Am(f_c)$ of the peak and a value $Am(f_i)$ of the adjacent peak, and the distance from the position corresponding to an integer multiple of $f_0$.

$$c_t = \frac{Amc(f_c)}{\overline{Amc}(f_i)} > 2, \text{ or } Am(f_C) - \max\{Am(f_i)\} > 13db \tag{25}$$

$$\text{and } \frac{|f_C - Lf_0|}{Lf_0} < 20\%$$

If Equation 25 holds, the corresponding harmonics are a periodic component. Otherwise, the corresponding harmonics are an aperiodic component. The lowest harmonic of the harmonics as the aperiodic component is used as a boundary frequency. In this case as well, since each harmonic is determined, a degree representing a periodicity in each band obtained by band division is calculated, and a boundary frequency is obtained based on the obtained degree representing the periodicity.

When a PSHF (Pitch Scaled Harmonic Filter) is to be used, this apparatus separates the spectrum in an entire band into two spectra as a periodic component and an aperiodic component instead of segmenting a spectrum into a high-frequency component as an aperiodic component and a low-frequency component as a periodic component by setting a boundary frequency for the spectrum. In this case, the apparatus obtains a discrete Fourier transform with a length b times the pitch, sets a component at a position corresponding to an integer multiple of b as a harmonic component, and obtains an aperiodic component from a component from which the harmonic component is removed. The aperiodic component generation unit 108 separates the spectrum selected by the parameter selection unit 107 into a periodic component and an aperiodic component to obtain the aperiodic component. The parameter mixing unit 109 obtains a periodic component from the first conversion spectral parameter, and mixes it with the above aperiodic component. In this case, the apparatus separates the spectrum into a periodic component representing information corresponding to an integer multiple of the fundamental frequency and an aperiodic component representing the other component.

Figure 18:
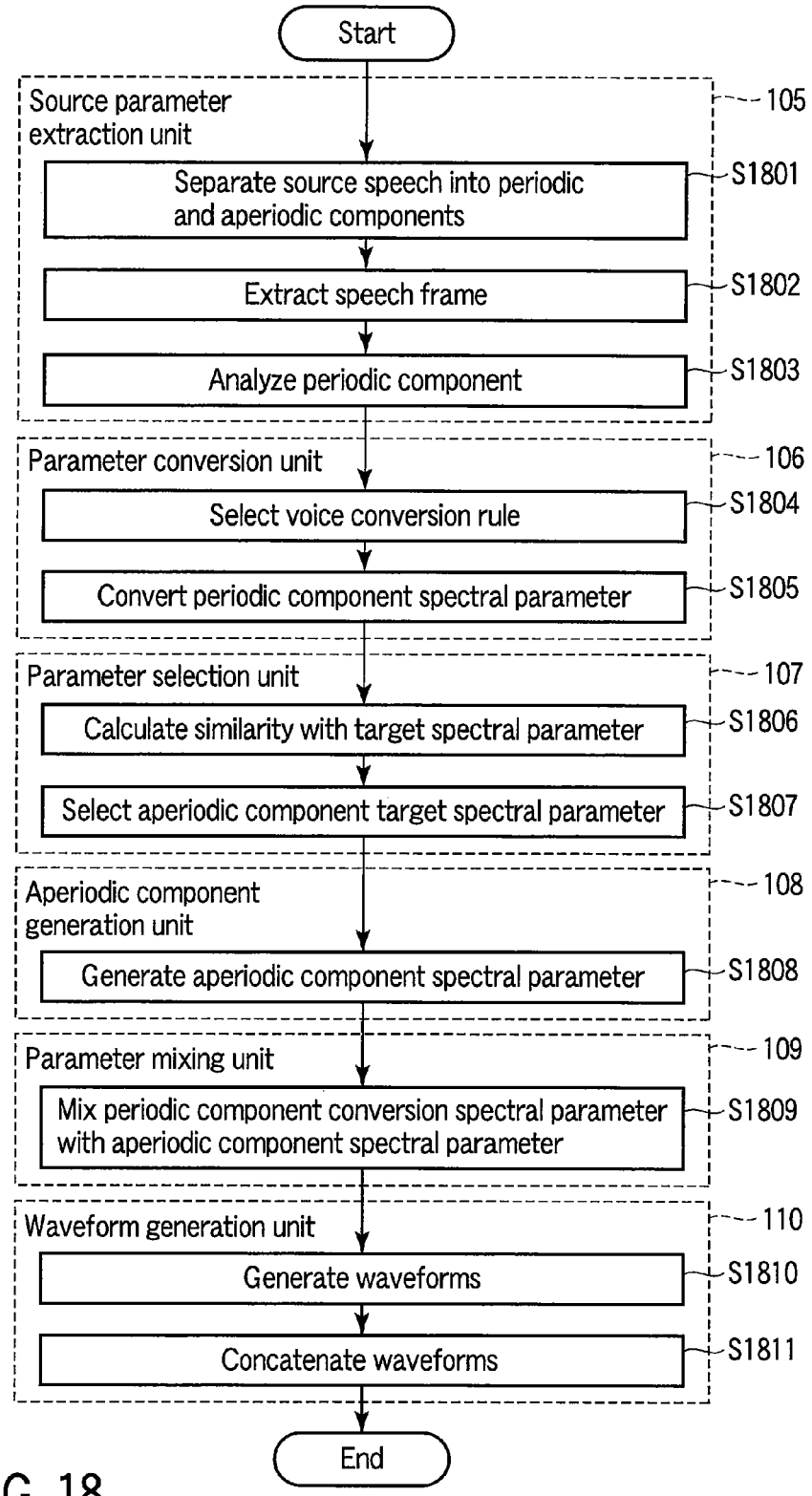
FIG. 18 is a flowchart for explaining another processing operation of the voice conversion apparatus in FIG. 1.

The above voice conversion apparatus internally separates a spectrum into a periodic component and an aperiodic component. However, the present invention is not limited to this. The apparatus may store, in the source parameter memory 101 and the target parameter memory 102 in advance, spectral parameters obtained from a speech spectrum which has been separated into a periodic component and an aperiodic component, and use the parameters for voice conversion. In practice, when separating a spectrum into a periodic component and an aperiodic component on the basis of harmonic components, the apparatus sometimes directly applies the above technique to speech data instead of spectral parameters. In this case, the apparatus needs to perform voice conversion by using speech components separated as a periodic component and an aperiodic component in advance. FIG. 18 shows the processing operation of the voice conversion apparatus in this case.

The voice conversion rule generation unit 103 generates a voice conversion rule by using a source spectral parameter of a periodic component stored in the source parameter memory 101 and a target spectral parameter of a periodic component stored in the target parameter memory 102. The generated voice conversion rule is stored in the voice conversion rule memory 104.

Upon receiving source speech, the source parameter extraction unit 105 separates the input source speech into a periodic component and an aperiodic component in step S1801. In step S1802, the source parameter extraction unit 105 extracts a speech frame. In step S1803, the source parameter extraction unit 105 obtains a periodic component source spectral parameter by performing spectral analysis on the periodic component. The source parameter extraction unit 105 extracts a speech frame from the input source speech and performs spectral analysis. The source parameter extraction unit 105 may then segment the spectrum into a periodic component and an aperiodic component and obtain the source spectral parameter of the periodic component.

In step S1804, the parameter conversion unit 106 then selects a voice conversion rule from the voice conversion rule memory 104. In step S1805, the parameter conversion unit 106 converts the source spectral parameter of the periodic component by applying the selected voice conversion rule to it to obtain the first conversion spectral parameter of the periodic component.

In step S1805, the parameter selection unit 107 obtains the similarity between the first periodic component conversion spectral parameter and each periodic component target spectral parameter stored in the target parameter memory 102. In step S1807, the parameter selection unit 107 selects, based on the similarities, an aperiodic component target spectral parameter corresponding to a periodic component target spectral parameter exhibiting a high similarity. At this time, the parameter selection unit 107 may select a plurality of aperiodic component target spectral parameters.

In step S1808, the aperiodic component generation unit 108 generates an aperiodic component spectral parameter from the selected aperiodic component target spectral parameter. If the parameter selection unit 107 has selected a plurality of aperiodic component target spectral parameters, the aperiodic component generation unit 108 generates one aperiodic component spectral parameter by averaging the plurality of aperiodic component target spectral parameters.

In step S1809, the parameter mixing unit 109 obtains the second conversion spectral parameter by mixing the first conversion spectral parameter of the periodic component with the generated aperiodic component spectral parameter.

In step S1810, the waveform generation unit 110 generates a speech waveform from the obtained second conversion spectral parameter. In step S1811, the waveform generation unit 110 obtains converted speech by concatenating the generated speech waveforms.

With the above processing, voice conversion can be performed by using speech separated into a periodic component and an aperiodic component in advance and their spectral parameters.

As described above, the voice conversion apparatus according to the first embodiment generates the periodic component of a target speech spectrum by performing voice conversion of the spectral parameter obtained from source speech, and generates the aperiodic component of a target speech spectrum by using the target spectral parameter obtained from the target speech. Mixing the generated spectral parameters of the periodic component and aperiodic component and generating a speech waveform can obtain voice-converted speech having an aperiodic component most suitable for target speech.

Second Embodiment

Figure 19:
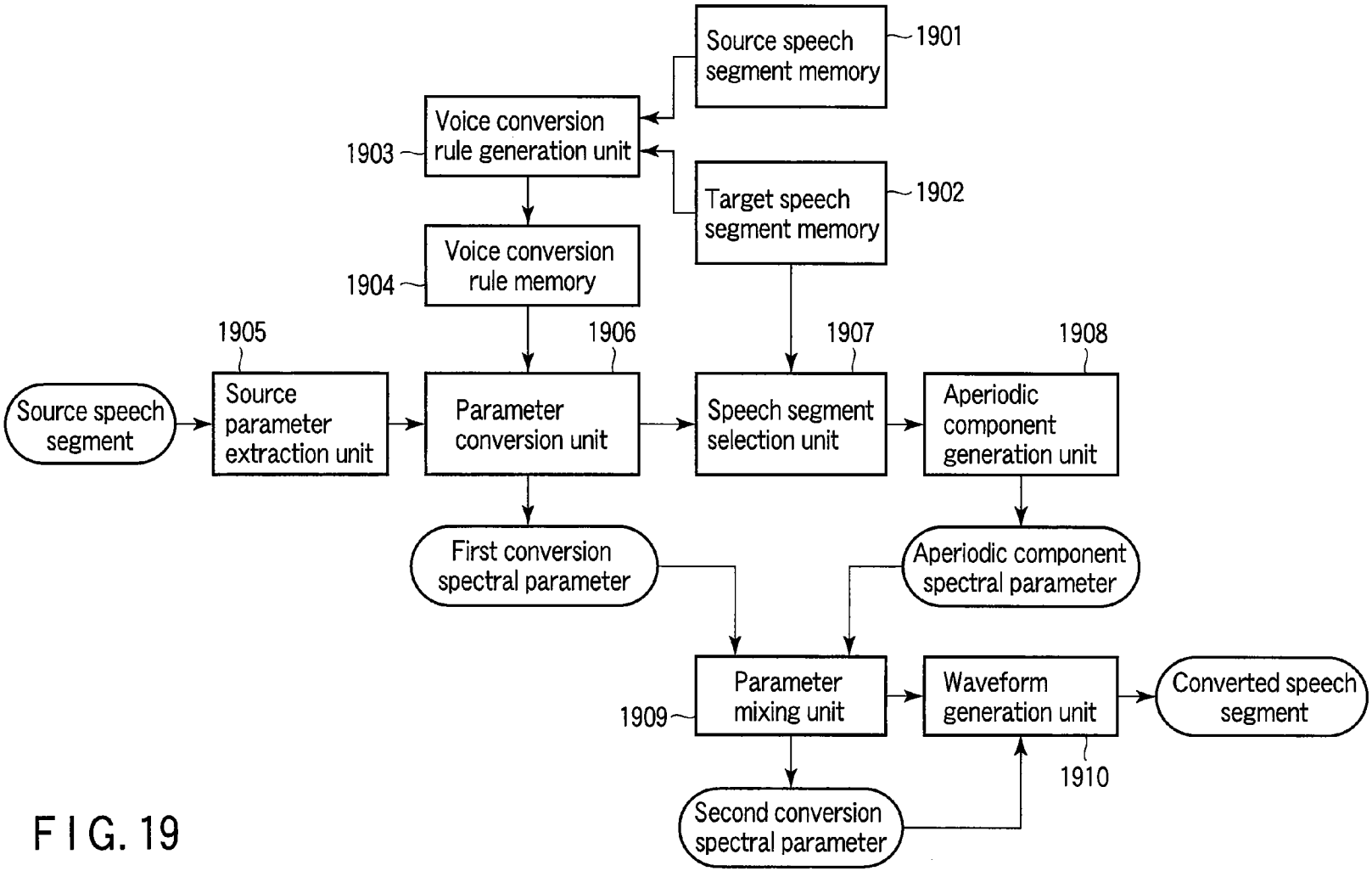
FIG. 19 is a block diagram showing an example of the arrangement of a voice conversion apparatus according to the second embodiment.

FIG. 19 is a block diagram showing an example of the arrangement of a voice conversion apparatus according to the second embodiment. The voice conversion apparatus in FIG. 19 obtains a target speech segment by converting a source speech segment. The voice conversion apparatus according to the first embodiment performs voice conversion processing for each speech frame as a unit of processing. Unlike this apparatus, the voice conversion apparatus according the second embodiment performs voice conversion processing for each speech segment as a unit of processing. In this case, a speech segment is a speech signal corresponding to a unit of speech. A unit of speech is a phoneme or a combination of phoneme segments. For example, a unit of speech is a half-phoneme, a phoneme (C, V), a diphone (CV, VC, VV), a triphone (CVC, VCV), a syllable (CV, V) (V: vowel, C: consonant). Alternatively, it may have a variable length as in a case in which a unit is a combination of them.

In the voice conversion apparatus in FIG. 19, a source speech segment memory 1901 stores a plurality of source speech segments and a target speech segment memory 1902 stores a plurality of target speech segments.

A voice conversion rule generation unit 1903 generates a voice conversion rule by using a source speech segment stored in the source speech segment memory 1901 and a target speech segment stored in the target speech segment memory 1902. The obtained voice conversion rule is stored in a voice conversion rule memory 1904.

A source parameter extraction unit 1905 segments an input source speech segment into speech frames, and extracts the source spectral parameter of each speech frame.

A parameter conversion unit 1906 generates the first conversion spectral parameter by voice conversion of the extracted source spectral parameter using the voice conversion rule stored in the voice conversion rule memory 1904.

When a speech segment selection unit 1907 selects a target speech segment from the target speech segment memory 1902, an aperiodic component generation unit 1908 generates the aperiodic component spectral parameter of each speech frame by associating each speech frame of the selected target speech segment with the speech frame of the source speech segment.

A parameter mixing unit 1909 generates the second conversion spectral parameter by mixing the periodic component conversion spectral parameter generated from the first conversion spectral parameter with the aperiodic component spectral parameter generated by the aperiodic component generation unit 1908. "Mixing" performed by the parameter mixing unit 1909 is to generate the second conversion spectral parameter by replacing a high-frequency portion higher than a boundary order q of the first conversion spectral parameter by the aperiodic component generated by the aperiodic component generation unit 1908.

A waveform generation unit 1910 obtains a converted speech segment by generating a speech waveform from the second conversion spectral parameter.

With the above arrangement, the voice conversion apparatus in FIG. 19 generates a target speech segment by voice conversion of an input source speech segment.

The source speech segment memory 1901 and the target speech segment memory 1902 respectively store the source speech segment obtained by segmenting the speech data of source voice quality and the spectral parameter of each frame and the target speech segment obtained by segmenting the speech data of target voice quality and the spectral parameter of each frame. The voice conversion rule generation unit 1903 generates a voice conversion rule by using the spectral parameters of the speech segments.

Figures 20, 21:
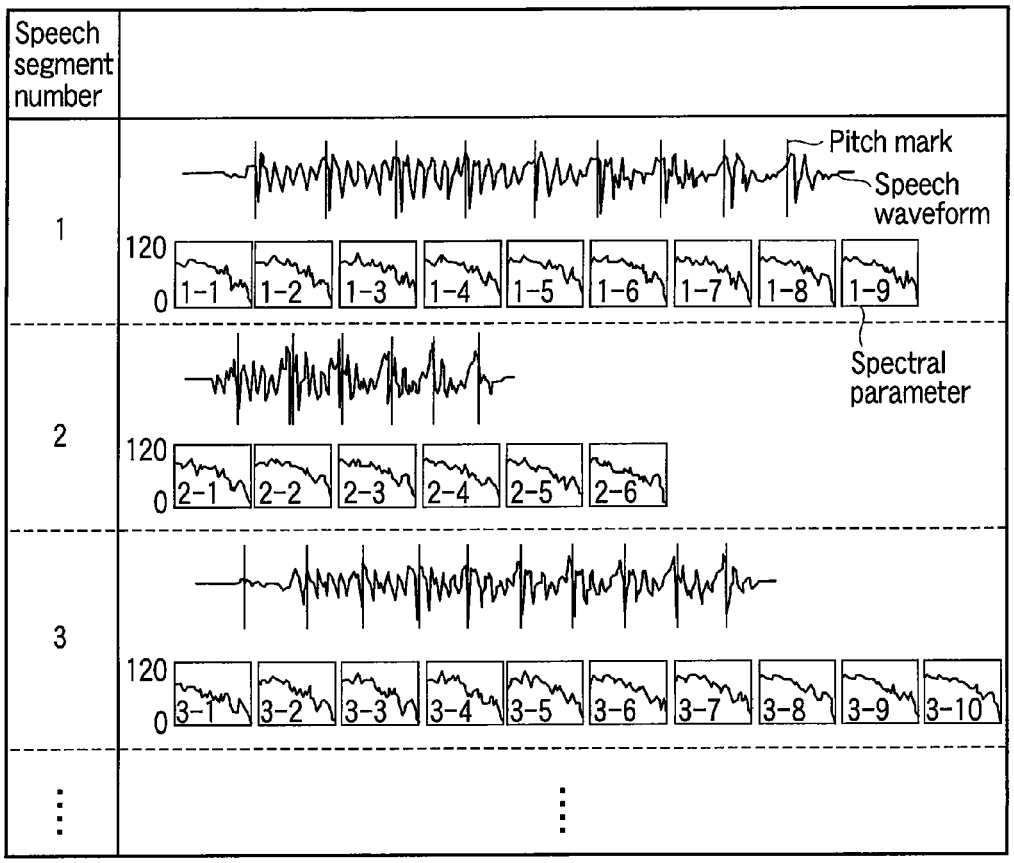
FIG. 20 is a view showing an example of how a source/target speech segment memory stores speech segments.
FIG. 21 is a view showing an example of the phonetic environment information (attribute information) of each speech segment stored in the source/target speech segment memory.

FIG. 20 shows examples of speech segment information stored in the speech segment memories 1901 and 1902. As the speech segment information of each speech segment, speech segment information including a speech waveform extracted on a speech basis, a pitch mark, and a spectral parameter at each pitch mark position is stored together with a speech segment number. The speech segment memories 1901 and 1902 store the phonetic environment shown in FIG. 21 together with each speech segment information described above. Phonetic environment information (attribute information) includes a speech segment number, its phoneme type, a fundamental frequency, a phoneme duration time, a spectral parameter at a concatenation boundary, phonetic environment information, and the like.

The voice conversion rule generation unit 1903 generates a voice conversion rule from the spectral parameter of a source speech segment stored in the source speech segment memory 1901 and the spectral parameter of a target speech segment stored in the target speech segment memory 1902.

The voice conversion rule memory 1904 stores a voice conversion rule for the spectral parameter of a speech segment and information for selecting a voice conversion rule if there are a plurality of voice conversion rules. A voice conversion rule is generated by the method described in the first embodiment, the method disclosed in patent reference 2, or the like.

The source parameter extraction unit 1905 obtains a spectral parameter from an input source speech segment. A source speech segment has the information of a pitch mark. The source parameter extraction unit 1905 extracts a speech frame corresponding to each pitch mark of a source speech segment, and obtains a spectral parameter by performing spectral analysis on the obtained speech frame.

The parameter conversion unit 1906 obtains the first conversion spectral parameter by performing voice conversion of the spectral parameter of a source speech segment by using a voice conversion rule stored in the voice conversion rule memory 1904.

The speech segment selection unit 1907 selects a target speech segment corresponding to a source speech segment from the target speech segment memory 1902. That is, the speech segment selection unit 1907 selects a target speech segment based on the similarity between the first conversion spectral parameter and each target speech segment stored in the target speech segment memory 1902. The similarity with the first conversion spectral parameter may be the spectral distance obtained by associating the spectral parameter of the target speech segment with the first conversion spectral parameter in the time direction. In addition, it is possible to obtain a similarity based on a cost function as a numerical value representing the difference between a phonetic environment such as prosodic or phonetic environment concerning a source speech segment and a phonetic environment concerning a target speech segment.

A cost function is represented as the linear sum of subcost functions $C_n(u_t, u_c)$ (n: 1, . . . , N where N is the number of subcost functions) generated for each attribute information. Reference symbol $u_t$ denotes a source speech segment; and $u_c$, a speech segment of the same phonology as that denoted by $u_t$ of the target speech segments stored in the target speech segment memory 1902. As subcost functions, this apparatus uses a fundamental frequency cost $C_1(u_t, u_c)$ representing the difference in fundamental frequency between a source speech segment and a target speech segment, a phoneme duration time cost $C_2(u_t, u_c)$ representing a difference in phoneme duration time, spectrum costs $C_3(u_t, u_c)$ and $C_4(u_t, u_c)$ representing differences in spectrum at a segment boundary, and phonetic environment costs $C_5(u_t, u_c)$ and $C_6(u_t, u_c)$ representing differences in phonetic environment. More specifically, a fundamental frequency cost is calculated as a difference in logarithmic fundamental frequency as follows:

$$C_1(u_t,u_c)=\{\log(f(u_t))-\log(f(u_c))\}^2 \tag{26}$$

where f(u) represents a function which extracts an average fundamental frequency from attribute information corresponding to a speech segment u. A phoneme duration time cost is calculated from $$C_2(u_t,u_c)=\{g(u_t)-g(u_c)\}^2 \tag{27}$$

where g(u) represents a function which extracts a phoneme duration time from attribute information corresponding to the speech segment u. A spectrum cost is calculated from the cepstrum distance of a speech segment at a boundary.

$$C_3(u_t,u_c)=\|h^l(u_t)-h^l(u_c)\|$$

$$C_4(u_t,u_c)=\|h^r(u_t)-h^r(u_c)\| \tag{28}$$

where $h^l(u)$ is a function which extracts a cepstrum coefficient as a vector at the left segment boundary of the speech segment u, and $h^r(u)$ is a function which extracts a cepstrum coefficient as a vector at the right segment boundary of the speech segment u. phonetic environment costs are calculated from distances representing whether adjacent segments are equal to each other.

$$C_5(u_t, u_C) = \begin{cases} 1 & \ldots \text{ left phonemic environments match} \\ 0 & \ldots \text{ others} \end{cases} \tag{29}$$

$$C_6(u_t, u_C) = \begin{cases} 1 & \ldots \text{ right phonemic environments match} \\ 0 & \ldots \text{ others} \end{cases}$$

A cost function representing the distortion between a target speech segment and a source speech segment is defined as the weighted sum of these subcost functions as indicated by $$C(u_t, u_C) = \sum_{n=1}^{N} w_n C_n(u_t, u_C) \tag{30}$$

where $w_n$ represents the weight of a subcost function. A predetermined value is used as this weight. Equation 30 is the cost function of a speech segment which represents distortion caused when a speech segment in the target speech segment memory 1902 is applied to a given source speech segment.

A target speech segment can be selected by using the cost between the source speech segment obtained by Equation 30 and the target speech segment as a similarity. The speech segment selection unit 1907 may select a plurality of target speech segments instead of one target speech segment.

The aperiodic component generation unit 1908 generates an aperiodic component spectral parameter from the target speech segment selected by the speech segment selection unit 1907. The aperiodic component generation unit 1908 separates the spectral parameter of the selected target speech segment into a periodic component and an aperiodic component, and extracts an aperiodic component spectral parameter. The aperiodic component generation unit 1908 can separate the spectral parameter into a periodic component and an aperiodic component in the same manner as in the first embodiment. When a plurality of target spectral parameters are selected, the aperiodic component generation unit 1908 generates one aperiodic component spectral parameter by averaging the aperiodic components of the spectral parameters of the plurality of target speech segments. The aperiodic component generation unit 1908 generates an aperiodic component spectral parameter from the spectral parameter of a target speech segment upon associating the spectral parameter of the target speech segment with the spectral parameter of a source speech segment in the time direction. With this operation, the aperiodic component generation unit 1908 generates aperiodic component spectral parameters equal in number to the first conversion spectral parameters.

The parameter mixing unit 1909 generates the second conversion spectral parameter from the first conversion spectral parameter and the generated aperiodic component spectral parameter. First of all, the parameter mixing unit 1909 separates the first conversion spectral parameter into a periodic component and an aperiodic component and extracts the periodic component as a periodic component conversion spectral parameter. The parameter mixing unit 1909 generates the second conversion spectral parameter by mixing the obtained periodic component conversion spectral parameter with the aperiodic component spectral parameter generated by the aperiodic component generation unit 1908.

The waveform generation unit 1910 obtains a converted speech segment by generating a speech waveform from the second conversion spectral parameter.

Figure 22:
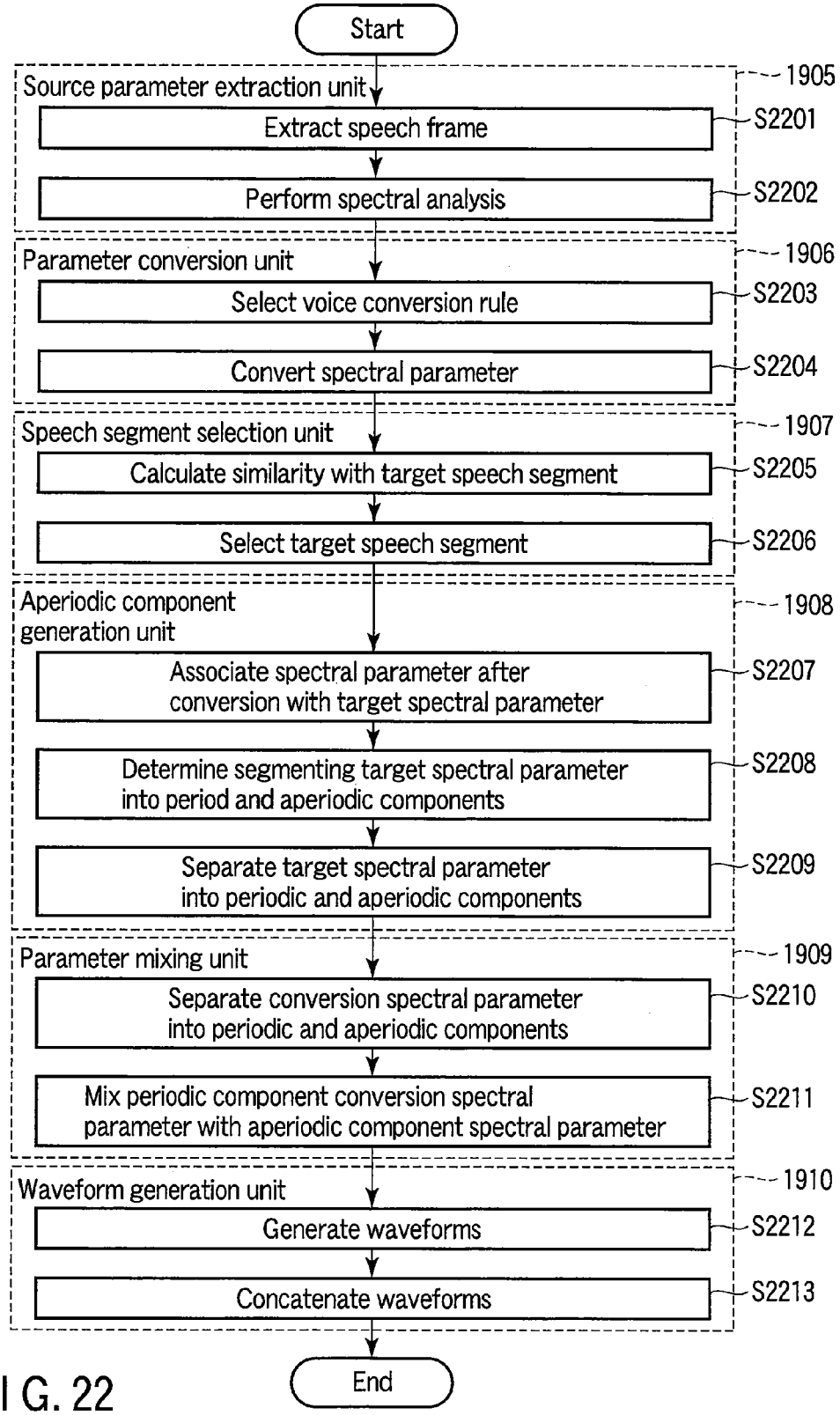
FIG. 22 is a flowchart for explaining the processing operation of the voice conversion apparatus in FIG. 19.

The processing operation of the voice conversion apparatus in FIG. 19 will be described next with reference to FIG. 22.

First of all, the source parameter extraction unit 1905 extracts the pitch waveform of a speech frame corresponding to each pitch mark time from an input source speech segment in step S2201. In step S2202, the source parameter extraction unit 1905 obtains a spectral parameter by analyzing the spectrum of an extracted pitch waveform.

In step S2203, the parameter conversion unit 1906 selects a voice conversion rule from the voice conversion rule memory 1904. In step S2204, the parameter conversion unit 1906 obtains the first conversion spectral parameter by converting a spectral parameter using the selected voice conversion rule.

In step S2205, the speech segment selection unit 1907 calculates the similarity between the obtained first conversion spectral parameter and each target speech segment stored in the target speech segment memory 1902. In step S2206, the speech segment selection unit 1907 selects a target speech segment based on the obtained similarity.

In step S2207, the aperiodic component generation unit 1908 associates the first conversion spectral parameter with each spectral parameter of the selected target speech segment in the time direction. These parameters are associated by equalizing the numbers of pitch waveforms by deleting and duplicating pitch waveforms.

In step S2208, the aperiodic component generation unit 1908 determines, for example, a boundary frequency necessary to separate the selected target spectral parameter or a spectrum obtained from the target spectral parameter into a periodic component and an aperiodic component. In step S2209, the aperiodic component generation unit 1908 extracts an aperiodic component spectral parameter by separating an aperiodic component from the target spectral parameter by using the determined boundary frequency.

In step S2202, the parameter mixing unit 1909 obtains a periodic component conversion spectral parameter by separating the periodic component from the first conversion spectral parameter. In step S2211, the parameter mixing unit 1909 obtains the second conversion spectral parameter by mixing the periodic component conversion spectral parameter with the aperiodic component spectral parameter obtained in step S2209.

In step S2212, the waveform generation unit 1910 generates a speech waveform from each spectral parameter obtained in this manner. In step S2213, the waveform generation unit 1910 generates voice-converted speech by concatenating these speech waveforms.

The voice conversion apparatus according to the second embodiment can perform voice conversion on a speech segment basis. This apparatus generates a periodic component by performing voice conversion of a spectral parameter obtained from a source speech segment and generates an aperiodic component from a selected target speech segment. Mixing these components can obtain a voice-converted speech segment having an aperiodic component optimal for target voice quality.

Third Embodiment

Figure 23:
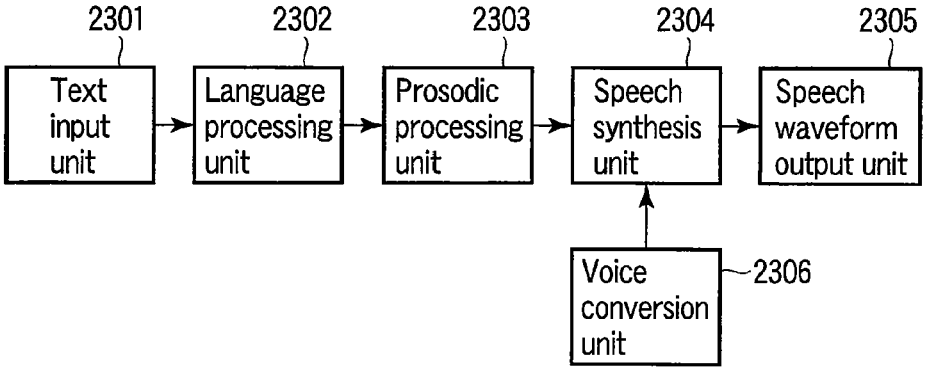
FIG. 23 is a block diagram showing an example of the arrangement of a speech synthesis apparatus according to the third embodiment.

FIG. 23 is a block diagram showing an example of the arrangement of a text speech synthesis apparatus according to the third embodiment. The text speech synthesis apparatus in FIG. 23 is a speech synthesis apparatus to which the voice conversion apparatus according to the second embodiment is applied. Upon receiving an arbitrary text sentence, this apparatus generates synthetic speech having target voice quality.

The text speech synthesis apparatus in FIG. 23 includes a text input unit 2301, a language processing unit 2302, a prosodic processing unit 2303, a speech synthesis unit 2304, a speech waveform output unit 2305, and a voice conversion unit 2306. The voice conversion unit 2306 is equivalent to the voice conversion apparatus in FIG. 19.

The language processing unit 2302 performs morphemic analysis/syntactic analysis on a text input from the text input unit 2301, and outputs the result to the prosodic processing unit 2303. The prosodic processing unit 2303 performs accent processing and information processing based on the language analysis result to generate and output a phoneme sequence and prosodic information to the speech synthesis unit 2304. The speech synthesis unit 2304 generates a speech waveform by using the phoneme sequence, the prosodic information, and the speech segment generated by the voice conversion unit 2306. The speech waveform output unit 2305 outputs the speech waveform generated in this manner.

Figure 24:
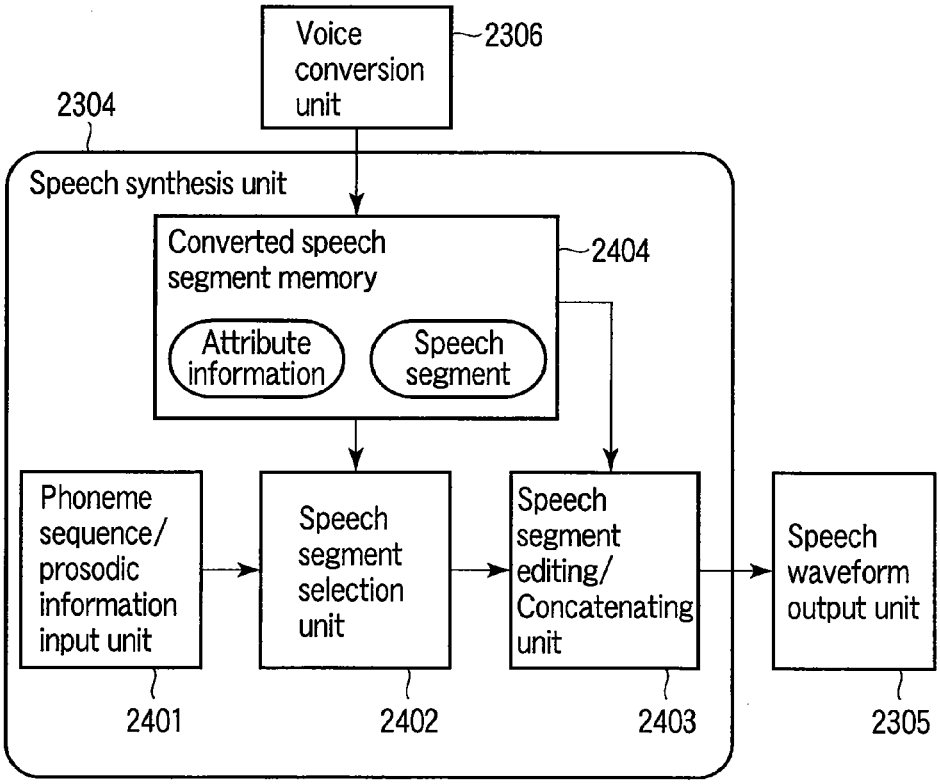
FIG. 24 is a block diagram showing an example of the arrangement of a speech synthesis unit.

FIG. 24 shows an example of the arrangement of the speech synthesis unit 2304 and voice conversion unit 2306 in FIG. 23. The speech synthesis unit 2304 includes a phoneme sequence/prosodic information input unit 2401, a speech segment selection unit 2402, a speech segment editing/concatenating unit 2403, and a converted speech segment memory 2404 which holds the converted speech segment and attribute information which are generated by the speech waveform output unit 2305 and the voice conversion unit 2306.

The voice conversion unit 2306 includes at least the same constituent elements as those of the voice conversion apparatus in FIG. 19 except for the source parameter extraction unit 1905, and converts each speech segment stored in a source speech segment memory 1901 into a target speech segment. That is, as indicated by steps S2203 to S2213 in FIG. 22, the voice conversion unit 2306 converts the voice quality of each speech segment stored in the source speech segment memory 1901 into the voice quality of target speech by using a target speech segment stored in a target speech segment memory 1902 and a voice conversion rule stored in a voice conversion rule memory 1904 in the same manner as that described in the second embodiment. The converted speech segment memory 2404 of the speech synthesis unit 2304 stores the speech segment obtained as a result of voice conversion performed by the voice conversion unit 2306.

The source speech segment memory 1901 and the target speech segment memory 1902 store speech segments that are generated by segmenting the source and target speech for predetermined unit of speech (unit of synthesis), and attribute information as in the second embodiment. As shown in FIG. 20, each speech segment is stored such that the waveform of a source speaker speech segment attached with a pitch mark is stored together with a number for identifying the speech segment. As shown in FIG. 21, as attribute information, information used by the speech segment selection unit 2402, e.g., a phoneme (half-phoneme name), a fundamental frequency, a phoneme duration time, a concatenation boundary cepstrum, and a phonetic environment, is stored together with the segment number of the speech segment. A speech segment and attribute information are generated from the speech data of a source speaker in steps such as a labeling step, a pitch marking step, an attribute generation step, and a segment extraction step.

In the voice conversion unit 2306, as described in the second embodiment, first of all, a parameter conversion unit 1906 generates the first conversion spectral parameter from the spectral parameter of each speech segment stored in the source speech segment memory 1901 by using a voice conversion rule stored in the voice conversion rule memory 1904. When a speech segment selection unit 1907 selects a target speech segment from the target speech segment memory 1902 as described above, an aperiodic component generation unit 1908 generates an aperiodic component spectral parameter by using the selected target speech segment, as described above. A parameter mixing unit 1909 generates the second conversion spectral parameter by mixing the periodic component conversion spectral parameter extracted from the first conversion spectral parameter with the aperiodic component spectral parameter generated by the aperiodic component generation unit 1908, and generates a waveform from the second conversion spectral parameter, thereby obtaining a converted speech segment. The converted speech segment obtained in this manner and its attribute information are stored in the converted speech segment memory 2404.

The speech synthesis unit 2304 selects a speech segment from the converted speech segment memory 2404 and performs speech synthesis. The phoneme sequence/prosodic information input unit 2401 receives a phoneme sequence and prosodic information which correspond to an input text output from the prosodic processing unit 2303. Prosodic information input to the phoneme sequence/prosodic information input unit 2401 includes a fundamental frequency and a phoneme duration time.

The speech segment selection unit 2402 segments an input phoneme sequence for each predetermined unit of speech (unit of synthesis). The speech segment selection unit 2402 estimates the degree of distortion of synthetic speech for each unit of speech on the basis of input prosodic information and attribute information held in the converted speech segment memory 2404, and selects a speech segment from the speech segments stored in the converted speech segment memory 2404 based on the degree of distortion of the synthetic speech. In this case, the degree of distortion of the synthetic speech is obtained as the weighted sum of an objective cost which is the distortion based on the difference between attribute information held in the converted speech segment memory 2404 and an objective phonetic environment input from the phoneme sequence/prosodic information input unit 2401 and a concatenation cost which is the distortion based on the difference in phonetic environment between speech segments to be connected.

A subcost function $C_n(u_i, u_{i-1}, t_i)$ (n:1, . . . , N, where N is the number of subcost functions) is determined for each factor for distortion caused when synthetic speech is generated by modifying and concatenating speech segments. A cost function used in the second embodiment is a cost function for measuring the distortion between two speech segments. A cost function defined in this case differs from the above cost function in that it is used to measure the distortion between an input prosodic/phoneme sequence and a speech segment. Reference symbol $t_i$ denotes objective attribute information of a speech segment of a portion corresponding to the ith segment when objective speech corresponding to an input phoneme sequence and input prosodic information is represented by $t=(t_1, \ldots, t_I)$; and $u_i$, a speech segment of the same phonology as $t_i$ of the speech segments stored in the converted speech segment memory 2404.

A subcost function is used to calculate a cost for estimating the degree of distortion of synthetic speech relative to objective speech which is caused when the synthetic speech is generated by using speech segments stored in the converted speech segment memory 2404. Objective costs to be used include a fundamental frequency cost $C_1(u_i, u_{i-1}, t_i)$ representing the difference between the fundamental frequency of a speech segment stored in the converted speech segment memory 2404 and an objective fundamental frequency, a phoneme duration time cost $C_2(u_i, u_{i-1}, t_i)$ representing the difference between the phoneme duration time of a speech segment and an objective phoneme duration time, and a phonetic environment cost $C_3(u_i, u_{i-1}, t_i)$ representing the difference between the phonetic environment of a speech segment and an objective phonetic environment. As a concatenation cost, a spectrum concatenation cost $C_4(u_i, u_{i-1}, t_i)$ representing a difference in spectrum at a concatenation boundary.

The weighted sum of these subcost functions is defined as the speech unit cost function represented by $$C(u_i, u_{i-1}, t_i) = \sum_{n=1}^{N} w_n C_n(u_i, u_{i-1}, t_i) \tag{31}$$

where $w_n$ represents the weight of a subcost function. In this embodiment, for the sake of simplicity, all weights $w_n$ are set to "1". Equation 31 represents the speech unit cost of a given speech segment when the speech segment is applied to a given unit of speech.

The value obtained by adding the results of calculation of speech unit costs for the respective segments obtained by segmenting an input phoneme sequence for each unit of speech according to Equation 31 with respect to all the segments is called a cost, and a cost function for calculating the cost is defined as indicated by $$\text{Cost} = \sum_{i=1}^{I} C(u_i, u_{i-1}, t_i) \tag{32}$$

The speech segment selection unit 2402 selects a speech segment by using the cost function represented by Equation 32. In this case, the speech segment selection unit 2402 obtains a speech segment sequence, from the speech segments stored in the converted speech segment memory 2404, which minimizes the value of the cost function calculated by Equation 32. A combination of speech segments which minimize this cost will be referred to as an optimal speech segment sequence. That is, each speech segment in the optimal speech segment sequence corresponds to each of a plurality of segments obtained by segmenting an input phoneme sequence for each unit of synthesis. The values of the speech unit cost calculated from each speech segment in the optimal speech segment sequence and the cost calculated by Equation 32 are smaller than that of any other speech segment sequence. Note that it is possible to search for an optimal speech segment sequence more efficiently by a dynamic programming (DP) method.

The speech segment editing/concatenating unit 2403 generates the speech waveform of synthetic speech by deforming and concatenating selected speech segments in accordance with input prosodic information. The speech segment editing/concatenating unit 2403 can generate a speech waveform by extracting pitch waveforms from selected speech segments and superimposing the pitch waveforms such that the fundamental frequency and phoneme duration time of each speech segment become the objective fundamental frequency and objective phoneme duration time indicated by input prosodic information.

Figure 25:
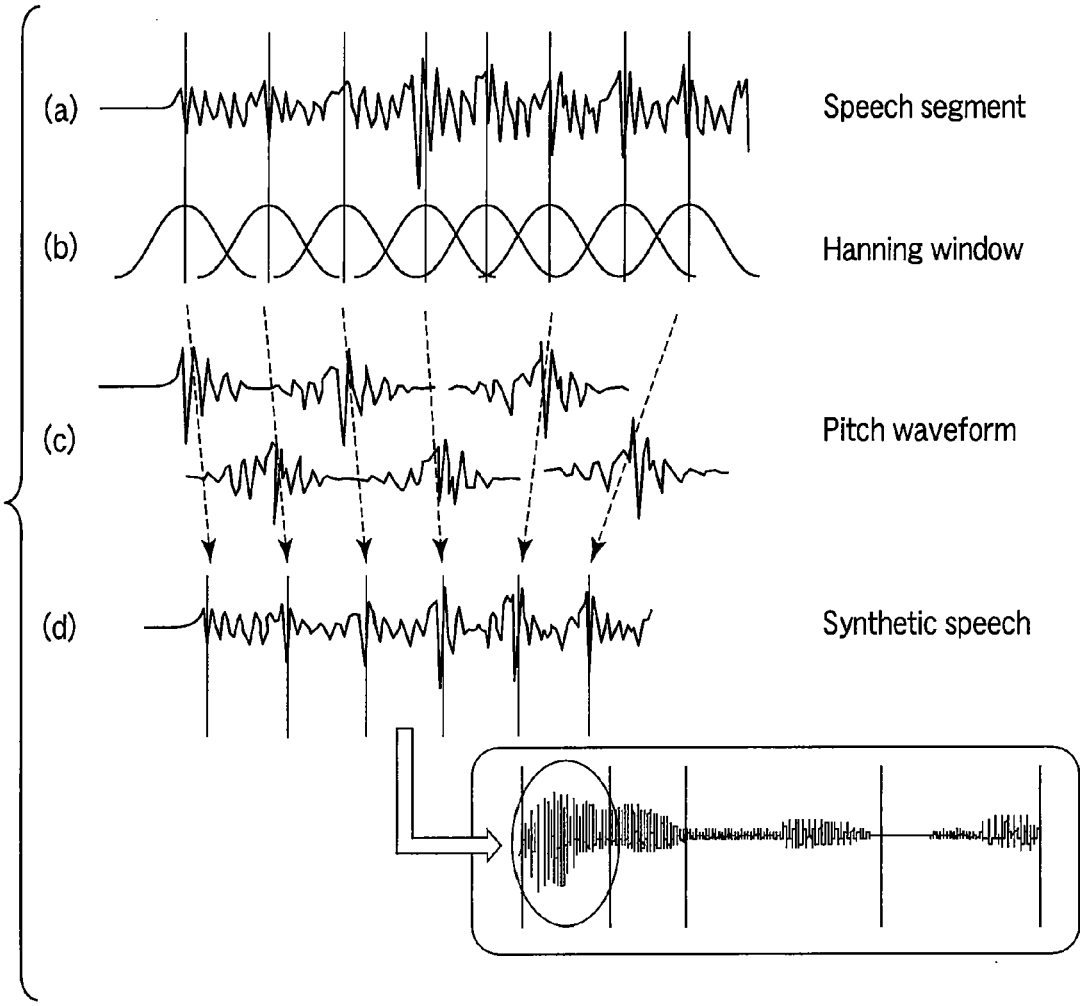
FIG. 25 explains processing in a speech waveform editing/conatenating unit.

FIG. 25 explains processing in the speech segment editing/concatenating unit 2403. FIG. 25 shows an example of how the speech waveform of the phoneme "a" of the synthetic speech "aisatsu", in which (a) in FIG. 25 shows a speech segment selected by the speech segment selection unit 2402, (b) in FIG. 25 shows a Hanning window for the extraction of a pitch waveform, (c) in FIG. 25 shows a pitch waveform, and (d) in FIG. 25 shows synthetic speech.

Referring to (d) in FIG. 25, each vertical line in the synthetic speech represents a pitch mark, which is generated in accordance with an objective fundamental frequency and objective phoneme duration time indicated by input prosodic information. The pitch waveforms extracted from the selected speech segment are superimposed/synthesized for each predetermined unit of speech in accordance with these pitch marks, thereby editing the segment and changing the fundamental frequency and the phoneme duration time. Synthetic speech is generated by concatenating adjacent pitch waveforms between units of speech.

As described above, the third embodiment can perform segment-selection speech synthesis by using the speech segments voice-converted by the voice conversion apparatus described in the second embodiment, and can generate synthetic speech corresponding to an input arbitrary text.

That is, the voice conversion apparatus described in the second embodiment generates a periodic component spectral parameter by applying the voice conversion rule generated by using a small quantity of speech segments of a target speaker to each speech segment stored in the source speech segment memory 1901. This apparatus generates a speech segment having the voice quality of the target speaker by using the second conversion spectral parameter generated by mixing the aperiodic component spectral parameter generated by using a speech segment selected from the speech segments of the converted speech with the periodic component spectral parameter, and stores the speech segment in the converted speech segment memory 2404. Synthesizing speech from speech segments stored in the converted speech segment memory 2404 can obtain synthetic speech of an arbitrary text sentence which has the voice quality of the target speaker. In addition, according to this embodiment, the apparatus can obtain a converted speech segment having a spectrum aperiodic component optimal for the voice quality of a target speaker, and hence can obtain natural synthetic speech of the target speaker.

Figure 26:
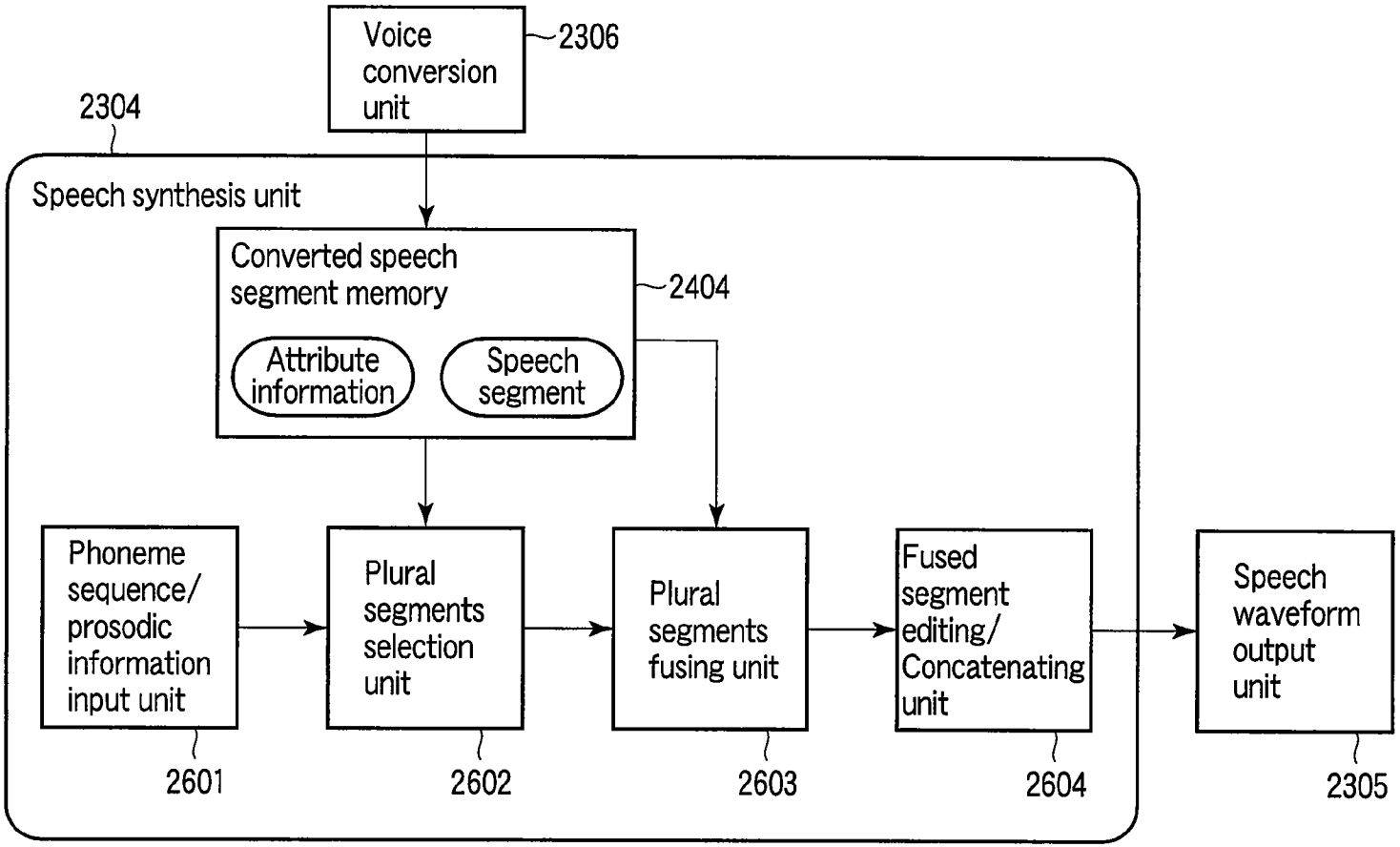
FIG. 26 is a block diagram showing an example of another arrangement of the speech synthesis apparatus.

The third embodiment has exemplified the case in which voice conversion is applied to speech synthesis of a type that selects one speech segment for one unit of speech (unit of synthesis). However, the present invention is not limited to this. It suffices to select a plurality of speech segments for one unit of speech and apply voice conversion to speech synthesis of a type that fuses these speech segments. FIG. 26 shows an example of the arrangement of the speech synthesis unit in this case. Note that the speech synthesis unit in FIG. 26 can also be used as the speech synthesis unit 2304 of the text speech synthesis apparatus in FIG. 23.

Referring to FIG. 26, the converted speech segment memory 2404 stores the converted speech segment generated by the voice conversion unit 2306 like the converted speech segment memory 2404 in FIG. 24.

A phoneme sequence/prosodic information input unit 2601 receives a phoneme sequence and prosodic information which are obtained as a result of text analysis and output from the prosodic processing unit 2303 in FIG. 23. A plural segments selection unit 2602 selects a plurality of speech segments for one unit of speech from the converted speech segment memory 2404 on the basis of the value of the cost calculated by Equation 32. A plural segments fusing unit 2603 generates a fused speech segment by fusing a plurality of selected speech segments. A fused segment editing/concatenating unit 2604 generates the speech waveform of synthetic speech by changing and concatenating prosodic information for the generated fused speech segment.

Processing in the plural segments selection unit 2602 and processing in the plural segments fusing unit 2603 can be performed by the technique disclosed in JP-A 2005-164749 (KOKAI). First of all, the plural segments selection unit 2602 selects an optimal speech segment sequence by using a DP algorithm so as to minimize the value of the cost function represented by Equation 32. The plural segments selection unit 2602 then selects a plurality of speech segments from the speech segments stored in the converted speech segment memory 2404 in ascending order of the value of the cost function which is obtained, for an interval corresponding to each unit of speech, as the sum of a concatenation cost between optimal speech segments in speech unit intervals before and after the interval and an objective cost in the interval.

As described above, the plural segments fusing unit 2603 fuses a plurality of speech segments selected for one interval to obtain a representative speech segment of the plurality of speech segments. In speech segment fusing processing in the plural segments fusing unit 2603, first of all, a pitch waveform is extracted from each selected speech segment. The number of extracted pitch waveforms is matched with pitch marks generated from objective prosodic information by duplicating or deleting pitch waveforms. A representative speech segment is then generated by averaging a plurality of pitch waveforms corresponding to the respective pitch marks by a time domain.

The fused segment editing/concatenating unit 2604 generates the speech waveform of synthetic speech by changing and concatenating prosodic information for a representative speech segment in each interval.

It has been confirmed that speech synthesis of a type that selects a plurality of segments and fuses them, which is shown in FIG. 26, can obtain synthetic speech with higher stability than that obtained by the segment-selection speech synthesis in FIG. 24. Therefore, the arrangement shown in FIG. 26 can generate synthetic speech having the voice quality of a target speaker with high stability and naturalness.

The above embodiment has exemplified the speech synthesis in which the speech segment selection unit 2402 and the plural segments selection unit 2602 select speech segments from the speech segments stored in the converted speech segment memory 2404. However, the present invention is not limited to this. The speech segment selection unit 2402 and the plural segments selection unit 2602 may select speech segments from the converted speech segments stored in the converted speech segment memory 2404 and the target speech segments stored in the target speech segment memory 1902. In this case, the speech segment selection unit 2402 and the plural segments selection unit 2602 select segments from the speech segments of the same phones stored in the converted speech segment memory 2404 and the target speech segment memory 1902. Note, however, that since the target speech segments stored in the target speech segment memory 1902 are assumed to have the same vocal quality as target vocal quality and are small in quantity, the ratio at which converted speech segments stored in the converted speech segment memory 2404 are selected becomes high. In order to control this ratio, it suffices to use a converted speech segment use cost $C_5(u_i, u_{i-1}, t_i)$ as one of the subcost functions used for the calculation of the cost function represented by Equation 30.

A target speech segment use cost is a cost function which returns "1" when a converted speech segment stored in the converted speech segment memory 2404 is to be used, and "0" when a target speech segment stored in the target speech segment memory 1902 is to be used. Using the value of a weight $w_5$ of this function can control the ratio at which a converted speech segment stored in the converted speech segment memory 2404 is selected. Setting the weight $w_5$ to proper values can properly switch and use a target speech segment and a converted speech segment. This makes it possible to obtain synthetic speech having higher voice quality of a target speaker.

The above embodiments have exemplified the cases in which voice conversion is applied to speech synthesis of the type that selects one speech segment and the type that selects a plurality of segments and fuses them. However, the present invention is not limited to them. For example, the first voice conversion and the second voice conversion can be applied to a speech synthesis apparatus (Japanese Patent No. 3281281) based on closed loop learning which is one of a number of segment-learning speech synthesis techniques.

In segment-learning speech synthesis, speech segments representing a plurality of speech segments as learning data are learned and held, and the learned speech segments are edited and connected in accordance with input phoneme sequence/prosodic information, thereby synthesizing speech. In this case, voice conversion is applied by converting the voice qualities of speech segments as learning data and learning representative speech segments from the converted speech segments obtained as a result of the voice conversion. In addition, applying voice conversion to learned speech segments can generate representative speech segments of the voice quality of a target speaker.

In the first to third embodiments, speech segments are analyzed and synthesized based on pitch synchronous analysis. However, the present invention is not limited to this. For example, since no pitch is observed in an unvoiced sound interval, pitch synchronous processing cannot be performed. In such an interval, voice conversion can be performed by analytic synthesis based on a fixed frame rate. Note, however, that analytic synthesis based on a fixed frame rate is not limited to unvoiced sound intervals and can be used for other intervals. In addition, it suffices to use speech segments of a source speaker without converting unvoiced speech segments.

The above voice conversion apparatus and speech synthesis apparatus can be implemented by using, for example, a general-purpose computer apparatus as basic hardware. That is, the voice conversion apparatus and speech synthesis apparatus make a processor installed in the above computer apparatus execute programs (e.g., the processing shown in FIGS. 2, 15, 18, and 22), thereby implementing the functions of the respective constituent elements of the voice conversion apparatus shown in FIG. 1 or 19. In addition, making the processor installed in the above computer apparatus execute programs can implement the functions of the respective constituent elements of the speech synthesis apparatus shown in FIG. 23 and the like.

In this case, the voice conversion apparatus and the speech synthesis apparatus can be implemented by installing the above programs in the computer apparatus in advance or can be implemented by storing the programs in a storage medium such as a CD-ROM or by distributing the programs via a network and installing the programs in the computer apparatus as needed.

In addition, the techniques of the present invention which have been described in the embodiments of the present invention can be distributed while being stored in recording media such as magnetic disks (flexible disks, hard disks, and the like), optical disks (CD-ROMs, DVDs, and the like), and semiconductor memories.

According to the above embodiments, it can easily generate high-quality speech having the voice quality of target speech from a small amount of target speech when converting the voice quality of source speech into the voice quality of target speech.

What is claimed is:

1. A voice conversion apparatus comprising:

a parameter memory to store a plurality of target speech spectral parameters representing characteristics of voice quality of target speech;

a voice conversion rule memory to store a voice conversion rule for converting voice quality of source speech into voice quality of the target speech;

an extraction unit configured to extract, from an input source speech, a source speech spectral parameter representing a characteristic of voice quality of the input source speech;

a parameter conversion unit configured to convert extracted source speech spectral parameter into a first conversion spectral parameter by using the voice conversion rule;

a parameter selection unit configured to select at least one target speech spectral parameter similar to the first conversion spectral parameter from the target speech spectral parameters stored in the parameter memory;

an aperiodic component generation unit configured to generate an aperiodic component spectral parameter representing an aperiodic component of voice quality from selected target speech spectral parameter;

a parameter mixing unit configured to mix a periodic component spectral parameter representing a periodic component of voice quality included in the first conversion spectral parameter with the aperiodic component spectral parameter, to obtain a second conversion spectral parameter; and a speech waveform generation unit configured to generate a speech waveform from the second conversion spectral parameter, wherein the aperiodic component generation unit determines a boundary frequency between the periodic component and the aperiodic component of voice quality from one of the selected target speech spectral parameter and the first conversion spectral parameter, and extracts, from the selected target speech spectral parameter, the aperiodic component spectral parameter whose frequency band is higher than the boundary frequency.

2. The apparatus according to claim 1, wherein the aperiodic component generation unit accumulates amplitude for each frequency of one of the selected target speech spectral parameter and the first conversion spectral parameter in ascending order of frequency, and determines the boundary frequency at which a accumulated value of amplitudes for each frequency up to the boundary frequency is maximum value equal to or less than a value obtained by multiplying a total accumulated value of amplitudes for each frequency throughout an entire frequency band by a predetermined value.

3. The apparatus according to claim 1, wherein the parameter memory further stores the aperiodic component of each target speech spectral parameter, and the aperiodic component generation unit generates the aperiodic component spectral parameter from the aperiodic component of one or more target speech spectral parameters which are similar to the first conversion spectral parameter and are stored in the parameter memory.

4. The apparatus according to claim 1, wherein the voice conversion rule memory stores, as the voice conversion rule, at least one of a frequency warping function which shifts the source speech spectral parameter in a frequency domain, a multiplication parameter which changes an amplitude for each frequency of the source speech spectral parameter, a difference parameter which represents a difference between the source speech spectral parameter and the target speech spectral parameter, and a regression analysis parameter between the source speech spectral parameter and the target speech spectral parameter.

5. A voice conversion apparatus comprising:

a parameter memory to store a plurality of target speech spectral parameters representing characteristics of voice quality of target speech;

a voice conversion rule memory to store a voice conversion rule for converting voice quality of source speech into voice quality of the target speech;

an extraction unit configured to extract, from an input source speech, a source speech spectral parameter representing a characteristic of voice quality of the input source speech;

a parameter conversion unit configured to convert extracted source speech spectral parameter into a first conversion spectral parameter by using the voice conversion rule;

a parameter selection unit configured to select at least one target speech spectral parameter similar to the first conversion spectral parameter from the target speech spectral parameters stored in the parameter memory;

an aperiodic component generation unit configured to generate an aperiodic component spectral parameter representing an aperiodic component of voice quality from selected target speech spectral parameter;

a parameter mixing unit configured to mix a periodic component spectral parameter representing a periodic component of voice quality included in the first conversion spectral parameter with the aperiodic component spectral parameter, to obtain a second conversion spectral parameter; and a speech waveform generation unit configured to generate a speech waveform from the second conversion spectral parameter, wherein the aperiodic component generation unit extracts the periodic component from frequency components which are integral multiples of a fundamental frequency included in the selected target speech spectral parameter, and extracts the aperiodic component spectral parameter from other than the periodic component included in the selected target speech spectral parameter.

6. The apparatus according to claim 5, wherein the aperiodic component generation unit segments the selected target speech spectral parameter into a plurality of bands, calculates, for each band, a degree of periodicity of the band, classifies the bands into the periodic component and the aperiodic component based on the degree of periodicity corresponding to each band, and determines the boundary frequency between the periodic component and the aperiodic component.

7. A voice conversion apparatus comprising:

a parameter memory to store a plurality of target speech spectral parameters representing characteristics of voice quality of target speech;

a voice conversion rule memory to store a voice conversion rule for converting voice quality of source speech into voice quality of the target speech;

an extraction unit configured to extract, from an input source speech, a source speech spectral parameter representing a characteristic of voice quality of the input source speech;

a parameter conversion unit configured to convert extracted source speech spectral parameter into a first conversion spectral parameter by using the voice conversion rule;

a parameter selection unit configured to select at least one target speech spectral parameter similar to the first conversion spectral parameter from the target speech spectral parameters stored in the parameter memory;

an aperiodic component generation unit configured to generate an aperiodic component spectral parameter representing an aperiodic component of voice quality from selected target speech spectral parameter;

a parameter mixing unit configured to mix a periodic component spectral parameter representing a periodic component of voice quality included in the first conversion spectral parameter with the aperiodic component spectral parameter, to obtain a second conversion spectral parameter; and a speech waveform generation unit configured to generate a speech waveform from the second conversion spectral parameter, wherein the parameter memory stores, as the target speech spectral parameters, the plurality of base coefficients which are determined to minimize a distortion between spectrum envelope information extracted from a speech signal of the target speech and a linear combination of a plurality of bases for each frequency and a plurality of base coefficients corresponding to the respective bases.

8. A voice conversion apparatus comprising:

a parameter memory to store a plurality of target speech spectral parameters representing characteristics of voice quality of target speech;

a voice conversion rule memory to store a voice conversion rule for converting voice quality of source speech into voice quality of the target speech;

an extraction unit configured to extract, from an input source speech, a source speech spectral parameter representing a characteristic of voice quality of the input source speech;

a parameter conversion unit configured to convert extracted source speech spectral parameter into a first conversion spectral parameter by using the voice conversion rule;

a parameter selection unit configured to select at least one target speech spectral parameter similar to the first conversion spectral parameter from the target speech spectral parameters stored in the parameter memory;

an aperiodic component generation unit configured to generate an aperiodic component spectral parameter representing an aperiodic component of voice quality from selected target speech spectral parameter;

a parameter mixing unit configured to mix a periodic component spectral parameter representing a periodic component of voice quality included in the first conversion spectral parameter with the aperiodic component spectral parameter, to obtain a second conversion spectral parameter; and a speech waveform generation unit configured to generate a speech waveform from the second conversion spectral parameter, wherein the parameter memory stores, as the target speech spectral parameter, one of a cepstrum, a mel-cepstrum, and an LSP parameter which represent characteristics of the voice quality of the target speech, the aperiodic component generation unit converts the selected target speech spectral parameter into a discrete spectrum and generates the aperiodic component spectral parameter from the discrete spectrum, and the parameter mixing unit converts the first conversion spectral parameter into a discrete spectrum, and mixes the periodic component extracted from the discrete spectrum with the aperiodic component spectral parameter, to obtain the second conversion spectral parameter.

9. A voice conversion apparatus comprising:

a parameter memory to store a plurality of target speech spectral parameters representing characteristics of voice quality of target speech;

a voice conversion rule memory to store a voice conversion rule for converting voice quality of source speech into voice quality of the target speech;

an extraction unit configured to extract, from an input source speech, a source speech spectral parameter representing a characteristic of voice quality of the input source speech;

a parameter conversion unit configured to convert extracted source speech spectral parameter into a first conversion spectral parameter by using the voice conversion rule;

a parameter selection unit configured to select at least one target speech spectral parameter similar to the first conversion spectral parameter from the target speech spectral parameters stored in the parameter memory;

an aperiodic component generation unit configured to generate an aperiodic component spectral parameter representing an aperiodic component of voice quality from selected target speech spectral parameter;

a parameter mixing unit configured to mix a periodic component spectral parameter representing a periodic component of voice quality included in the first conversion spectral parameter with the aperiodic component spectral parameter, to obtain a second conversion spectral parameter; and a speech waveform generation unit configured to generate a speech waveform from the second conversion spectral parameter, wherein the parameter memory further stores a phase parameter together with each target speech spectral parameter, the phase parameter representing a characteristic of a phase spectrum, of the target speech, corresponding to the target speech spectral parameter, the extraction unit further extracts a source speech phase parameter representing a characteristic of a phase spectrum of the input source speech therefrom, the aperiodic component generation unit generates an aperiodic component phase parameter representing the aperiodic component from the phase parameter corresponding to the selected target speech spectrum, the parameter mixing unit mixes the periodic component phase parameter representing the periodic component extracted from the source speech phase parameter and the aperiodic component phase parameter, to generate a conversion phase parameter, and the speech waveform generation unit generates the speech waveform from the second conversion spectral parameter and the conversion phase parameter.

10. A speech synthesis apparatus comprising:

a voice conversion apparatus comprising:

a first speech segment memory to store a plurality of speech segments of target speech, together with spectral parameters and attribute information which represent characteristics of the respective speech segments;

a voice conversion rule memory to store a voice conversion rule for converting voice quality of source speech into voice quality of the target speech;

an extraction unit configured to extract, from a speech segment of an input source speech, a source speech spectral parameter representing a characteristic of voice quality of the speech segment of the input source speech;

a parameter conversion unit configured to convert the extracted source speech spectral parameter into a first conversion spectral parameter by using the voice conversion rule;

a selection unit configured to select one or more speech segments from the speech segments stored in the first speech segment memory based on at least one of a similarity between the spectral parameter of each speech segment and the first conversion spectral parameter and a similarity between attribute information of each speech segment and attribute information of the input source speech;

an aperiodic component generation unit configured to generate an aperiodic component spectral parameter representing an aperiodic component of voice quality from one or more spectral parameters of the selected one or more speech segments;

a parameter mixing unit configured to mix a periodic component spectral parameter representing a periodic component of voice quality included in the first conversion spectral parameter with the aperiodic component parameter, to obtain a second conversion spectral parameter; and a speech waveform generation unit configured to generate a speech waveform from the second conversion spectral parameter;

a second speech segment memory to store a plurality of speech segments whose speech waveforms are generated by the voice conversion apparatus and attribute information of each speech segment;

a speech segment selection unit configured to segment a phoneme sequence of an input text into a plurality of speech units each having a predetermined length, and select one or more speech segments from the speech segments stored in the speech segment memory for each speech unit based on the attribute information of the speech unit; and a speech waveform generation unit configured to generate a speech waveform by concatenating selected speech segments each being selected for one speech unit of the speech units or representative speech segments each being obtained by fusing selected speech segments for one speech unit of the speech units, wherein the speech segment selection unit selects, for each speech unit, one or more speech segments from the speech segments stored in the second speech segment memory and one or more speech segments of the target speech stored in the first speech segment.

11. The apparatus according to claim 10, wherein the attribute information of each speech segment stored in the first speech segment memory includes at least one of a fundamental frequency, a phoneme duration time, a phonetic environment, and spectral information.

12. A voice conversion method including:

storing, in a parameter memory, a plurality of target speech spectral parameters representing characteristics of voice quality of target speech;

storing, in a voice conversion rule memory, a voice conversion rule for converting voice quality of source speech into voice quality of the target speech;

extracting, from an input source speech, a source speech spectral parameter representing a characteristic of voice quality of the input source speech;

converting extracted source speech spectral parameter into a first conversion spectral parameter by using the voice conversion rule;

selecting at least one target speech spectral parameter similar to the first conversion spectral parameter from the target speech spectral parameters stored in the parameter memory;

generating an aperiodic component spectral parameter representing an aperiodic component of voice quality from selected target speech spectral parameter;

mixing a periodic component spectral parameter representing a periodic component of voice quality included in the first conversion spectral parameter with the aperiodic component spectral parameter, to obtain a second conversion spectral parameter;

generating a speech waveform from the second conversion spectral parameter;

determining a boundary frequency between the periodic component and the aperiodic component of voice quality from one of the selected target speech spectral parameter and the first conversion spectral parameter; and extracting, from the selected target speech spectral parameter, the aperiodic component spectral parameter whose frequency band is higher than the boundary frequency.

13. A voice conversion method including:

storing, in a parameter memory, a plurality of target speech spectral parameters representing characteristics of voice quality of target speech;

storing, in a voice conversion rule memory, a voice conversion rule for converting voice quality of source speech into voice quality of the target speech;

extracting, from an input source speech, a source speech spectral parameter representing a characteristic of voice quality of the input source speech;

converting extracted source speech spectral parameter into a first conversion spectral parameter by using the voice conversion rule;

selecting at least one target speech spectral parameter similar to the first conversion spectral parameter from the target speech spectral parameters stored in the parameter memory;

generating an aperiodic component spectral parameter representing an aperiodic component of voice quality from selected target speech spectral parameter;

mixing a periodic component spectral parameter representing a periodic component of voice quality included in the first conversion spectral parameter with the aperiodic component spectral parameter, to obtain a second conversion spectral parameter;

generating a speech waveform from the second conversion spectral parameter;

extracting the periodic component from frequency components which are integral multiples of a fundamental frequency included in the selected target speech spectral parameter; and extracting the aperiodic component spectral parameter from other than the periodic component included in the selected target speech spectral parameter.

14. A voice conversion method including:

storing, in a parameter memory, a plurality of target speech spectral parameters representing characteristics of voice quality of target speech;

storing, in a voice conversion rule memory, a voice conversion rule for converting voice quality of source speech into voice quality of the target speech;

extracting, from an input source speech, a source speech spectral parameter representing a characteristic of voice quality of the input source speech;

converting extracted source speech spectral parameter into a first conversion spectral parameter by using the voice conversion rule;

selecting at least one target speech spectral parameter similar to the first conversion spectral parameter from the target speech spectral parameters stored in the parameter memory;

generating an aperiodic component spectral parameter representing an aperiodic component of voice quality from selected target speech spectral parameter;

mixing a periodic component spectral parameter representing a periodic component of voice quality included in the first conversion spectral parameter with the aperiodic component spectral parameter, to obtain a second conversion spectral parameter;

generating a speech waveform from the second conversion spectral parameter; and storing, in the parameter memory, as the target speech spectral parameters, the plurality of base coefficients which are determined to minimize a distortion between spectrum envelope information extracted from a speech signal of the target speech and a linear combination of a plurality of bases for each frequency and a plurality of base coefficients corresponding to the respective bases.

15. A voice conversion method including:

storing, in a parameter memory, a plurality of target speech spectral parameters representing characteristics of voice quality of target speech;

storing, in a voice conversion rule memory, a voice conversion rule for converting voice quality of source speech into voice quality of the target speech;

extracting, from an input source speech, a source speech spectral parameter representing a characteristic of voice quality of the input source speech;

converting extracted source speech spectral parameter into a first conversion spectral parameter by using the voice conversion rule;

selecting at least one target speech spectral parameter similar to the first conversion spectral parameter from the target speech spectral parameters stored in the parameter memory;

generating an aperiodic component spectral parameter representing an aperiodic component of voice quality from selected target speech spectral parameter;

mixing a periodic component spectral parameter representing a periodic component of voice quality included in the first conversion spectral parameter with the aperiodic component spectral parameter, to obtain a second conversion spectral parameter;

generating a speech waveform from the second conversion spectral parameter;

storing, in the parameter memory, as the target speech spectral parameter, one of a cepstrum, a mel-cepstrum, and an LSP parameter which represent characteristics of the voice quality of the target speech;

converting the selected target speech spectral parameter into a discrete spectrum;

generating the aperiodic component spectral parameter from the discrete spectrum;

converting the first conversion spectral parameter into a discrete spectrum; and mixing the periodic component extracted from the discrete spectrum with the aperiodic component spectral parameter, to obtain the second conversion spectral parameter.

16. A voice conversion method including:

storing, in a parameter memory, a plurality of target speech spectral parameters representing characteristics of voice quality of target speech;

storing, in a voice conversion rule memory, a voice conversion rule for converting voice quality of source speech into voice quality of the target speech;

extracting, from an input source speech, a source speech spectral parameter representing a characteristic of voice quality of the input source speech;

converting extracted source speech spectral parameter into a first conversion spectral parameter by using the voice conversion rule;

selecting at least one target speech spectral parameter similar to the first conversion spectral parameter from the target speech spectral parameters stored in the parameter memory;

generating an aperiodic component spectral parameter representing an aperiodic component of voice quality from selected target speech spectral parameter;

mixing a periodic component spectral parameter representing a periodic component of voice quality included in the first conversion spectral parameter with the aperiodic component spectral parameter, to obtain a second conversion spectral parameter;

generating a speech waveform from the second conversion spectral parameter;

storing, in the parameter memory, a phase parameter together with each target speech spectral parameter, the phase parameter representing a characteristic of a phase spectrum, of the target speech, corresponding to the target speech spectral parameter;

extracting a source speech phase parameter representing a characteristic of a phase spectrum of the input source speech therefrom;

generating an aperiodic component phase parameter representing the aperiodic component from the phase parameter corresponding to the selected target speech spectrum;

mixing the periodic component phase parameter representing the periodic component extracted from the source speech phase parameter and the aperiodic component phase parameter, to generate a conversion phase parameter; and generating the speech waveform from the second conversion spectral parameter and the conversion phase parameter.

17. A speech synthesis method including:

storing, in a first speech segment memory, a plurality of speech segments of target speech, together with spectral parameters and attribute information which represent characteristics of the respective speech segments;

storing, in a voice conversion rule memory, a voice conversion rule for converting voice quality of source speech into voice quality of the target speech;

extracting, from a speech segment of an input source speech, a source speech spectral parameter representing a characteristic of voice quality of the speech segment of the input source speech;

converting the extracted source speech spectral parameter into a first conversion spectral parameter by using the voice conversion rule;

selecting one or more speech segments from the speech segments stored in the first speech segment memory based on at least one of a similarity between the spectral parameter of each speech segment and the first conversion spectral parameter and a similarity between attribute information of each speech segment and attribute information of the input source speech;

generating an aperiodic component spectral parameter representing an aperiodic component of voice quality from one or more spectral parameters of the selected one or more speech segments;

mixing a periodic component spectral parameter representing a periodic component of voice quality included in the first conversion spectral parameter with the aperiodic component parameter, to obtain a second conversion spectral parameter;

generating a speech waveform from the second conversion spectral parameter;

storing, in a second speech segment memory, a plurality of speech segments from the speech waveforms and attribute information of each speech segment;

segmenting a phoneme sequence of an input text into a plurality of speech units each having a predetermined length;

selecting, for each speech unit, one or more speech segments from the speech segments stored in the speech segment memory based on the attribute information of the speech unit;

generating a speech waveform by concatenating selected speech segments each being selected for one speech unit of the speech units or representative speech segments each being obtained by fusing selected speech segments for one speech unit of the speech units; and selecting, for each speech unit, one or more speech segments from the speech segments stored in the second speech segment memory and one or more speech segments of the target speech stored in the first speech segment.

* * * * *